US008233013B2

(12) United States Patent
Morisue et al.

(10) Patent No.: US 8,233,013 B2
(45) Date of Patent: Jul. 31, 2012

(54) TRANSMISSIVE-TYPE LIQUID CRYSTAL DISPLAY DEVICE

(75) Inventors: Takashi Morisue, Nara (JP); Tsuyoshi Muramatsu, Nara (JP); Hiroshi Tanaka, Soraku-gun (JP); Atsushi Aoki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1260 days.

(21) Appl. No.: 11/958,077

(22) Filed: Dec. 17, 2007

(65) Prior Publication Data

US 2008/0150863 A1 Jun. 26, 2008

(30) Foreign Application Priority Data

Dec. 21, 2006 (JP) ..... 2006-345017
Feb. 9, 2007 (JP) ..... 2007-031239

(51) Int. Cl.
*G09G 5/10* (2006.01)

(52) U.S. Cl. ..... 345/690; 345/87; 348/256; 348/645

(58) Field of Classification Search ..... 345/87–88, 345/690; 348/645–647, 649, 655, 254–255
See application file for complete search history.

(56) References Cited

U.S. PATENT DOCUMENTS

| | | | | |
|---|---|---|---|---|
| 6,515,700 | B2 * | 2/2003 | Nakamura et al. | 348/256 |
| 6,954,191 | B1 | 10/2005 | Hirano et al. | |
| 7,133,049 | B2 | 11/2006 | Lee et al. | |
| 2006/0114265 | A1 | 6/2006 | Nishida | |
| 2006/0125773 | A1 | 6/2006 | Ichikawa et al. | |
| 2007/0064162 | A1 * | 3/2007 | Yamamoto et al. | 348/790 |

FOREIGN PATENT DOCUMENTS

| | | |
|---|---|---|
| JP | 11-065531 | 3/1999 |
| JP | 2002-149116 | 5/2002 |
| JP | 2005-196175 | 7/2005 |
| JP | 2006-154064 | 6/2006 |
| JP | 2007-10753 A | 1/2007 |
| KR | 10-2006-0056247 | 5/2006 |
| KR | 10-0658776 B1 | 12/2006 |

* cited by examiner

*Primary Examiner* — Seokyun Moon
(74) *Attorney, Agent, or Firm* — Nixon & Vanderhye P.C.

(57) ABSTRACT

In a transmissive-type liquid crystal display device including a liquid crystal panel and a backlight, the liquid crystal panel has pixels each divided into four subpixels red (R), green (G), blue (B), and white (W). The backlight is a white backlight by which luminance of emitted light is controllable. A color-saturation reducing section carries out a process of reducing color saturation on a first RGB input signal, which is an original input signal, so that the first RGB input signal becomes a second RGB input signal. Thereafter, an output signal generating section obtains a transmissivity and a backlight value on the basis of the second RGB input signal.

8 Claims, 17 Drawing Sheets

FIG. 5 (a)

INPUT SIGNAL (Rsi, Gsi, Bsi)

| | |
|---|---|
| A:(200, 200, 190) | B:(180, 100, 80) |
| C:(130, 150, 70) | D:(100, 120, 80) |

FIG. 5 (b)

AMOUNT OF TRANSMISSION (Rtsi, Gtsi, Bsti, Wtsi)

| | |
|---|---|
| A:(100, 100, 90, 100) | B:(100, 20, 0, 80) |
| C:(60, 80, 0, 70) | D:(40, 60, 20, 60) |

FIG. 5 (c)

BACKLIGHT VALUE OF EACH PIXEL

| | |
|---|---|
| A:100 | B:100 |
| C:80 | D:60 |

⇨ BACKLIGHT VALUE : 100

FIG. 5 (d)

TRANSMISSIVITY (rsi, gsi, bsi, wsi)

| | |
|---|---|
| A:(1.0, 1.0, 0.9, 1.0) | B:(1.0, 0.2, 0.0, 0.8) |
| C:(0.6, 0.8, 0.0, 0.7) | D:(0.4, 0.6, 0.2, 0.6) |

FIG. 5 (e)

DISPLAY LUMINANCE

| | |
|---|---|
| A:(200, 200, 190) | B:(180, 100, 80) |
| C:(130, 150, 70) | D:(100, 120, 80) |

TRANSMISSIVE-TYPE LIQUID CRYSTAL DISPLAY DEVICE

This Nonprovisional application claims priority under 35 U.S.C. §119(a) on Patent Applications No. 345017/2006 filed in Japan on Dec. 21, 2006, and No. 31239/2007 filed in Japan on Feb. 9, 2007, the entire contents of which are hereby incorporated by reference.

FIELD OF THE INVENTION

The present invention relates to a transmissive-type liquid crystal display device using an active backlight as a light source.

BACKGROUND OF THE INVENTION

There are various types of color displays, and they have become practical. Thin displays are roughly classified into self-emitting displays, such as PDP (plasma display panel), and non-luminescent displays exemplified by LCD (liquid crystal display). A known LCD, which is a non-luminescent display, is a transmissive-type LCD having a backlight on a rear side of the liquid crystal panel.

FIG. 13 is a sectional view showing a common configuration of the transmissive-type LCD. The transmissive-type LCD has a backlight 110 on a rear side of a liquid crystal panel 100. The liquid crystal panel 100 is configured in such a manner that a liquid crystal layer 103 is provided between a pair of transparent substrates 101 and 102, and polarizers 104 and 105 are provided on outer sides of the transparent substrates 101 and 102, respectively. Further, a color filter 106 is provided in the liquid crystal panel 100 so that color displays become available.

Although not illustrated, an electrode layer and an alignment layer are provided inside of the transparent substrates 101 and 102. Voltage to be applied to the liquid crystal layer 103 is controlled so that the amount of light passing through the liquid crystal panel 100 is controlled on a pixel-to-pixel basis. Specifically, the transmissive-type LCD controls light from the backlight 110 in such a manner that the amount of light that is to pass through is controlled at the liquid crystal panel 100, thereby controlling displays.

The backlight 110 emits light that contains wavelengths of three colors RGB necessary for color displays. In combination with the color filter 106, respective RGB are adjusted in transmissivity of light, whereby it becomes possible to determine luminance and hue of the pixels arbitrarily. White-color light sources, such as Electro-luminescence (EL), cold-cathode fluorescent lamps (CCFL), and light emitting diodes (LED) are commonly used as the backlight 110.

As shown in FIG. 14, plural pixels are arranged in matrix in the liquid crystal panel 100. Each of the pixels is generally constituted of three subpixels. The respective subpixels are disposed so as to correspond to filter layers red (R), green (G), and blue (B) in the color filter 106, respectively. Hereinafter, the subpixels will be referred to as a subpixel R, a subpixel G, and a subpixel B, respectively.

Respective subpixels R, G, and B selectively transmit, out of white-color light emitted from the backlight 110, the light having the corresponding wavelength band (i.e. red, green, blue), and absorbs the light having other wavelength bands.

In the transmissive-type LCD of the foregoing configuration, the light emitted from the backlight 110 is controlled in such a manner that the amount of light that is to pass through is controlled at each pixel of the liquid crystal panel 100. This naturally causes some of the light to be absorbed by the liquid crystal panel 100. Further, respective subpixels R, G, and B in the color filter 106 also absorb, out of the white-color light emitted from the backlight 110, the light having a wavelength band other than the corresponding wavelength band. Since the liquid crystal panel and the color filter absorb a great amount of light, the use of the light emitted from the backlight becomes less efficient. Accordingly, a common transmissive-type LCD has the problem of increase in power consumption of the backlight, The use of an active backlight by which luminance of light emitted is adjustable according to an image displayed is known as a technique that reduces the power consumption of transmissive-type LCD (e.g. Japanese Unexamined Patent Publication No. 65531/1999 (Tokukaihei 11-65531 (published on Mar. 9, 1999)).

Specifically, Publication No. 65531/1999 discloses the technique that reduces the power consumption of the backlight by employing an active backlight by which the luminance is adjustable, and controlling the liquid crystal panel and the active backlight in transmissivity and in luminance, respectively, thereby controlling displays (luminance control) shown on the LCD.

In Publication No. 65531/1999, the luminance of the backlight is controlled so as to match the greatest luminance in the input image (input signal). Further, the transmissivity of the liquid crystal panel is adjusted according to the current luminance of the backlight.

At this time, a transmissivity of a subpixel that is the highest value in the input signal is 100%. Further, the transmissivities other than the highest value, which transmissivities are obtained by calculation on the basis of the backlight value, are 100% or below each. This makes it possible to darken the backlight if the image is dark overall, whereby the power consumption of the backlight is reduced.

Accordingly, in Publication No. 65531/1999, the brightness of the backlight is restrained to a minimum necessary brightness on the basis of the input signals RGB of the input image, and the transmissivity of the liquid crystal is increased by the amount equal to that by which the backlight is darkened. This makes it possible to reduce the amount of light absorbed by the liquid crystal panel, whereby the power consumption of the backlight is reduced.

With the foregoing conventional configuration, the amount of light absorbed by the liquid crystal panel is reduced so that the power consumption of the backlight is reduced. However, the amount of light absorbed by the color filter is not reducible with the conventional configuration. If it becomes possible to reduce the amount of light absorbed by the color filter, the power consumption is reduced further.

SUMMARY OF THE INVENTION

An object of the present invention is to provide a transmissive-type liquid crystal display device by which the amount of light absorbed by not only a liquid crystal panel but also a color filter is reduced, whereby the power consumption is reduced further.

To attain the above object, the transmissive-type liquid crystal display device of the present invention includes: a liquid crystal panel having pixels each divided into four subpixels red (R), green (G), blue (B), and white (W); a white-color active backlight by which a luminance of light that is to be emitted is controllable; a color-saturation reducing section that carries out a process of reducing color saturation on pixel data that is high in luminance and in color saturation, among pixel data contained in a first RGB input signal which is an input image, so that the first RGB input signal is converted into a second RGB input signal; an output signal generating section that generates, from the second RGB input signal, a transmissivity signal of each of the subpixels R, G, B, W of each pixel of the liquid crystal panel, and calculates a backlight value in the active backlight; a liquid crystal panel controlling section that controls and drives the liquid crystal panel on the basis of the transmissivity signal generated in the output signal generating section; and a backlight controlling section that controls, on the basis of the backlight value calculated in the output signal generating section, the luminance of light that is to be emitted from the backlight.

With this configuration, the liquid crystal panel in which a single pixel is divided into four subpixels R, G, B, W is employed. This makes it possible to transfer a part of the respective color components K, G, B to the subpixel W, in which no loss (or little loss) of light due to absorption by a filter is produced. This makes it possible to reduce the amount of light absorbed by the color filter and therefore to reduce the backlight value, whereby it becomes possible to achieve reduction in power consumption in the transmissive-type liquid crystal display device.

Further, the process of reducing color saturation is carried out on the first RGB input signal, which is the original input, and the backlight value and the respective RGBW transmissivities are calculated on the basis of the second RGB input signal, which has undergone the process of reducing color saturation. This makes it possible to reduce the backlight value more reliably.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 3(*b*) is a comparative figure illustrating how the backlight value is obtained in Publication No. 65531/1999.

FIG. 4(*b*) is a comparative figure illustrating how a backlight value is obtained in Publication No. 65531/1999.

FIGS. 5(*a*) to 5(*e*) are figures illustrating how the backlight value and transmissivities of the subpixels are determined in the liquid crystal display device.

FIG. 15(*b*) is a comparative figure illustrating how the backlight value is obtained in Publication No. 65531/1999.

FIG. 16(*b*) is a comparative figure illustrating how the backlight value is obtained in Publication No. 65531/1999.

FIG. 17(*b*) is a comparative figure illustrating how the backlight value is obtained in Publication No. 65531/1999.

FIG. 18(*b*) is a comparative figure illustrating how the backlight value is obtained in Publication No. 65531/1999.

DESCRIPTION OF THE EMBODIMENTS

The following describes an embodiment of the present invention, with reference to the drawings. A schematic configuration of a liquid crystal display device of the present embodiment (the display device will be referred to as a present liquid crystal display device hereinafter) is discussed first in the following description, with reference to FIG. 1.

The present liquid crystal display device includes a color-saturation reducing section 11, an output signal generating section 12, a liquid crystal panel controlling section 13, an RGBW liquid crystal panel (the panel will be simply referred to as a liquid crystal panel hereinafter) 14, a backlight controlling section 15, and a white-color backlight (the white-color backlight will be simply referred to as a backlight hereinafter) 16.

Figure 2:
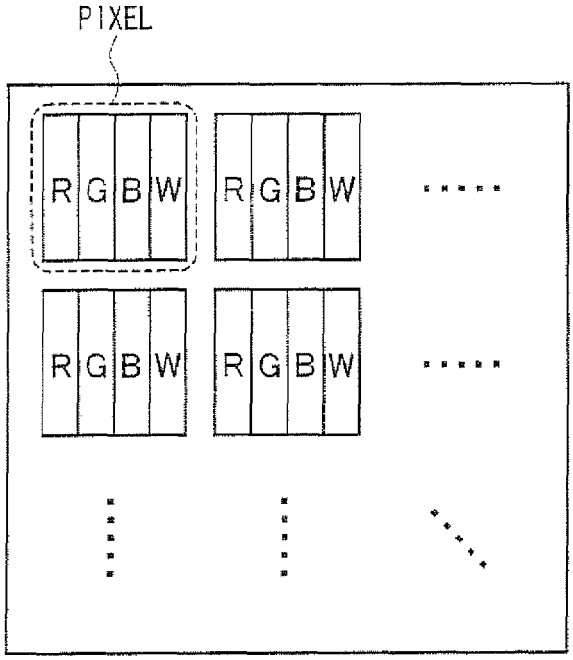
FIGS. 2(*a*) and 2(*b*) are figures illustrating examples of arrangements of subpixels in the transmissive-type liquid crystal display device.
Figure 2:
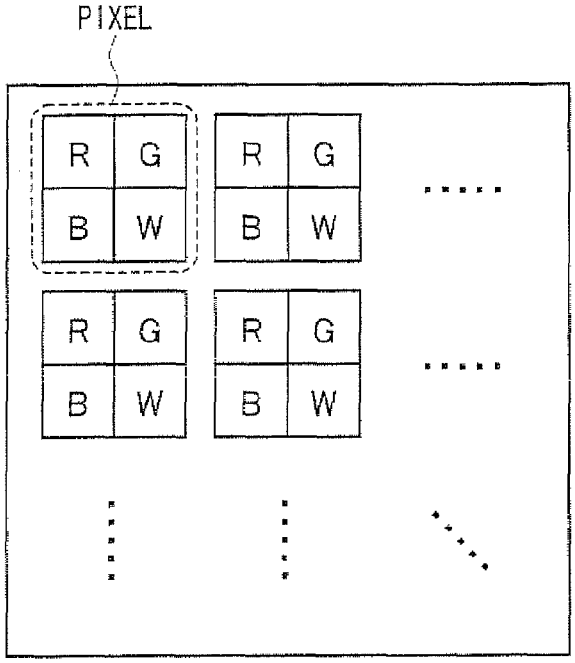

The liquid crystal panel 14 is constituted of Np pieces of pixels arranged in matrix. As shown in FIGS. 2(*a*) and 2(*b*), each pixel is constituted of four sub pixels R (red), G (green), B (blue), and W (white). Note that the shapes of the subpixels RGBW and the arrangement of the subpixels RGBW in the respective pixels are particularly limited. Further, the backlight 16 is an active backlight using a white-color light source such as cold cathode fluorescence lumps (CCFL) and white-color light emitting diodes (white-color LED), which active backlight allows control of the brightness of the light that is to be emitted.

The subpixels R, G, B in the liquid crystal panel 14 are arranged in such a way as to correspond to filter layers R, G, B in the color filter (not illustrated), respectively. Thus, the respective subpixels R, G, B selectively transmit, out of the white-color light emitted from the backlight 16, the light having the corresponding wavelength band, and absorb the light having other wavelength bands. Further, the subpixel W basically has no corresponding absorption filter layer in the color filter. In other words, the light having passed through the subpixel W is in no way absorbed by the color filter, and outgoes from the liquid crystal panel 14 as the white-color light. It should be noted, however, that the subpixel W may have a filter layer that less absorbs the light from the backlight than the respective color filters R, G, B do.

The light emitted from the subpixel W is white color. If the subpixels RGB have the same transmissivity, the light emitted from respective subpixels RGB collectively becomes white in color. It should be noted, however, that even if the subpixels RGB and the subpixel W are same in transmissivity, the brightness of the white-color light emitted as an aggregate of the light from the respective subpixels RGB is not always the same as that of the white-color light emitted from the subpixel W. The reason therefor is that the brightness varies according to the sizes of the subpixels and to the amount of light absorbed by the color filters of the respective subpixels.

The intensity ratio of the white-color light emitted from the subpixels KGB to the white-color light emitted from the subpixel W at this time is referred to as a white-color luminance ratio WR. Concretely, the white-color luminance ratio WK is P2/P1, where P1 is a display luminance P1 of the case in which the subpixels KGB each have the transmissivity of x % and the subpixel W has the transmissivity of 0%, and P2 is a display luminance P2 of the case in which the subpixels RGB each have the transmissivity of 0% and the subpixel W has the transmissivity of x %. Normally, the white-color luminance ratio WR is uniform across a sheet of liquid crystal panel (that is to say, in every pixel).

The present liquid crystal display device receives RGB signals (first RGB input signal), which is image information that is to be displayed, from external devices such as personal computers and television tuners, and carries out processing by use of the KGB signals as input signals Ri, Gi, Bi (i=1, 2, . . . , Np).

The color-saturation reducing section 11 carries out, when necessary, a process of reducing color saturation on the first RGB input signal, and then supplies this first RGB input signal, as a second RGB input signal, to the output signal generating section 12.

The output signal generating section 12 is a means of obtaining, on the basis of the second RGB input signal, a transmissivity of each subpixel in the liquid crystal panel 14 and a backlight value in the backlight 16. Specifically, the output signal generating section 12 obtains the backlight value Wbs based on input signals Rsi, Gsi, Bsi, which are second RGB input signals, and converts the input signals Rsi, Gsi, Bsi into transmissivity signals rsi, gsi, bsi, wsi according to the backlight value Wbs.

The backlight value Wbs thus obtained is supplied to the backlight controlling section 15. The backlight controlling section 15 adjusts the luminance of the backlight 16 in accordance with the backlight value Wbs. The backlight 16 uses a white-color light source such as CCFL and white-color LED. With the backlight controlling section 15, it is possible to control the brightness so as to be proportional to the backlight value. The way to control the brightness of the backlight 16 varies according to the types of the light sources that are employed. For example, the brightness is controllable by applying an electric voltage relative to the backlight value or by passing an electric current relative to the backlight value. If the backlight is an LED, the brightness is also controllable by changing a duty ratio with pulse width modulation (PWM). If the brightness of the backlight light source has a nonlinear characteristic, it is also possible to control the brightness to a desired brightness by obtaining, from a look-up table on the basis of the backlight value, an electric voltage or an electric current that is to be applied to the light source.

The transmissivity signals rsi, gsi, bsi, wsi are supplied to the liquid crystal panel controlling section 13. On the basis of the transmissivity signals, the liquid crystal panel controlling section 13 controls the respective transmissivities of the subpixels of the liquid crystal panel 14 so that each of the transmissivities becomes a desired transmissivity. The liquid crystal panel controlling section 13 includes a scan line driving circuit, a signal line driving circuit, and the like. The liquid crystal panel controlling section 13 generates scan signals and data signals, and drives the liquid crystal panel 14 with the use of panel control signals such as the scan signal and the data signal. The transmissivity signals rsi, gsi, bsi, wsi are utilized to generate the data signals in the signal line driving circuit. The liquid crystal panel 14 controls the transmissivity in various ways, including: controlling the transmissivity of the liquid crystal panel by applying an electric voltage proportionate to the transmissivity of the subpixel; and controlling looking up, on the basis of the transmissivity of the subpixel, an electric voltage in a look-up table, which electric voltage is to be applied to the liquid crystal panel in order to make the nonlinear characteristic linear, whereby the liquid crystal panel is controlled to have a desired transmissivity.

It should be noted that the input signals are not limited to the above-described KGB signals in the liquid crystal display device of the present invention. The input signals may be color signals such as YUV signals. If a color signal other than the RGB signal is to be supplied, the color signal may be converted into the KGB signal and then supplied to the output signal generating section 12. Alternatively, the output signal generating section 12 may be configured in such a manner that the output signal generating section 12 is allowed to convert a color input signal other than the RGB signal into an RGBW signal.

In the present liquid crystal display device, the display luminance of each subpixel of the liquid crystal panel 14 is represented by the brightness (luminance of light emitted) of the backlight, the transmissivity of the subpixel, and the white-color luminance ratio WR. If the brightness of each of the subpixels RGB is a product of the brightness of the backlight and the transmissivity of the subject subpixel, then the brightness of the subpixel W is expressed in terms of the product of the brightness of the backlight, the transmissivity of the subpixel W, and the white-color luminance ratio WR. Note that the display luminance of each subpixel is proportional to the transmission-amount of the subject subpixel.

It should be noted that although the term "backlight value" is used in the present embodiment, the backlight value is not an identical value to the brightness of the backlight in the strict sense but is in a proportional relationship to the brightness of the backlight. Similarly, the transmission-amount of the subpixel is not an identical value but is in a proportional relationship to the brightness of the subpixel. In other words, the backlight value in the present embodiment is a signal that is to be transmitted to the backlight and is merely in a proportional relationship to the actual brightness.

Concretely, in the present embodiment, the transmission-amount is obtainable by multiplying the backlight value and the transmissivity (and WR in the case of the subpixel W) together. Further, the brightness of the subpixel is obtainable by multiplying the luminance (brightness) of the backlight, the transmissivity of the color filter of each subpixel, and the LCD transmissivity of the subpixel together.

Further, the white-color luminance ratio WK is expressed by (white-color luminance by the subpixels RGB):(white-color luminance by the subpixel W), with RGB being the reference. The white-color luminance ratio is also obtainable by (transmissivity by the color filter W)/(transmissivity by the color filter RGB).

The following describes in detail the display principles and the effects of reduction in power consumption in the present liquid crystal display device. The backlight value and the subpixel transmissivity are obtained in the output signal generating section 12 in the present liquid crystal display device. Thus, the following process of calculating the backlight value and the subpixel transmissivity is to be carried out on the second RGB input signal supplied from the color-saturation reducing section 11 to the output signal generating section 12.

In the present liquid crystal display device, the backlight value and the subpixel transmissivity are determined as follows. First, a minimum-necessary backlight value is obtained for the respective pixels within the display area that corresponds to the backlight. Then, on the basis of the minimum-necessary backlight values thus obtained for the respective pixels, the highest value in the sheet of image is obtained. The highest value thus obtained is determined as the backlight value. The way to obtain the minimum-necessary backlight value for the respective pixels varies between the following two ways according to the content of the display data of the pixels. Concretely, the way to obtain the backlight value for the target pixel differs according to the relationship between the maximum luminance (i.e. max (Rsi, Gsi, Bsi)) and the minimum luminance (i.e. min (Rsi, Gsi, Bsi)) of the subpixels in the target pixel.

First, the following describes the way to obtain the minimum-necessary backlight value for the target pixel to satisfy min (Rsi, Gsi, Bsi)≧max (Rsi, Gsi, Bsi)/(1+1/WR).

Let the highest value among the second RGB input signals Rsi, Gsi, Bsi, which are to be supplied to the output signal generating section, be maxRKGBsi, and let the lowest value among the second KGB input signals Rsi, Gsi, Bsi be minRGBsi. Although the following discusses the case in which the color component corresponding to the highest value maxRGBsi is R (red), the case in which maxRGBsi corresponds to G (green) and the case in which maxRGBsi corresponds to B (blue) can be considered in the same manner. Note that maxRGBsi and minRGBsi are both values that are expressed in terms of the transmission-amount of the subpixel.

If display light of the component R, which is the transmission-amount maxRGBsi, is solely considered, transferring the transmission amount to the subpixels R and W in such a manner that the transmissivities of the subpixels R and W each become 100% allows the backlight value to be reduced to a minimum with respect to the display light.

Since the transmissivities of the subpixels R and W are 100% each, if the white-color luminance ratio WR is taken into consideration, the luminance of light emitted from the subpixel R is Blmin, and the luminance of light emitted from the subpixel W is WR×Blmin, where Blmin denotes the minimum-necessary backlight value. The sum of the light emitted from the subpixel R and the light emitted from the subpixel W, that is to say (1+WR)×Blmin, is the transmission-amount of the component R. Since (1+WR)×Blmin is equal to maxRGBsi, Blmin is maxRGBsi/(1+WR).

It should be noted, however, that the foregoing only considers the display light of the component R, so that neither of the components C and B is taken into consideration. In reality, if the backlight value is set to maxRGBsi/(1+WR) when minRGBsi<maxRGBsi/(1+1/WR), the transmission amount of the color component, which transmission amount corresponds to the lowest value minRGBsi, exceeds a necessary amount, as the following formula implies $$\max RGBsi/(1+WR)\times WR=\max RGBsi/(1+1/WR)>\min RGBsi.$$

Thus, the minimum-necessary backlight value in the target pixel is set to maxRGBsi/(1+WR) in accordance with the foregoing view only if minRGBsi≧maxRGBsi/(1+1/WR) is satisfied in the target pixel.

In the target pixel where minRGBsi<maxRGBsi/(1+1/WR), minRGBsi is the maximum transmission-amount transferable to the subpixel W in such a manner that the transmission-amount of the color component that corresponds to the lowest value minRGBsi does not exceed the necessary amount. In this case, the transmission amount in the subpixel of the color component that corresponds to the highest value maxRGBsi is transferred to the subpixel W by the same amount, whereby the transmission amount thereafter becomes maxRGBsi−minRGBsi. As a result, the minimum-necessary backlight value for the target pixel becomes maxRGBsi−minRGBsi.

The minimum-necessary backlight value is obtained for each pixel accordingly, and the highest one of the necessary backlight values for all pixels in the sheet of an image is determined as the backlight value Wbs.

The respective transmissivities of the subpixels are obtained as follows on the basis of the backlight value Wbs. The respective RGB transmissivities are expressed as (transmission amount)/(backlight value). Since the subpixel W is brighter than the subpixels RGB by the white-color luminance ratio WR, the backlight value necessary for the output luminance of the subpixel W is calculable by multiplying the backlight value necessary for the subpixels RGB by 1/WR. Therefore, the transmissivity of the subpixel W is expressed as (transmission amount)/(backlight value)/(white-color luminance ratio).

The following describes concrete examples, with reference to FIGS. 3, 4, and 15 to 18.

Figure 3:
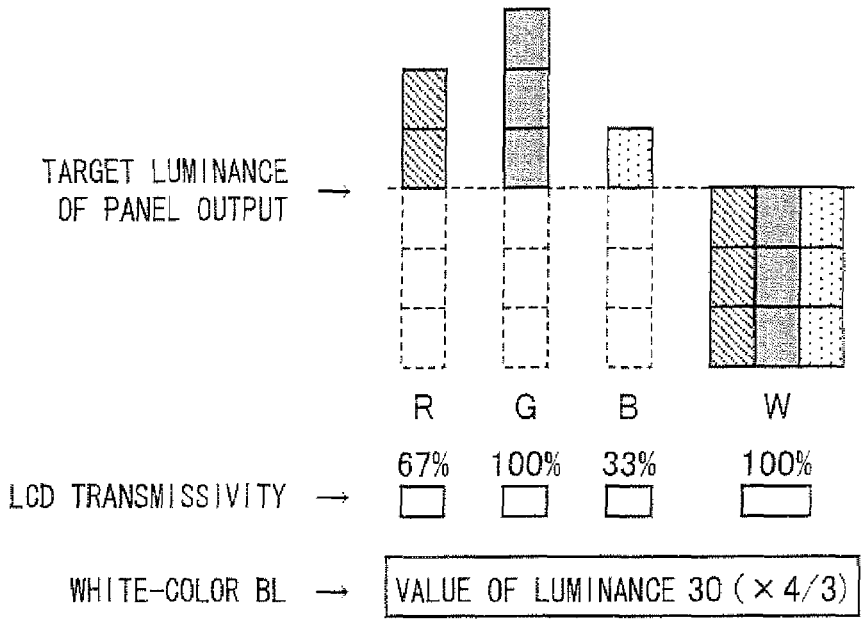
FIG. 3(*a*) is a figure illustrating how a backlight value is obtained in the liquid crystal display device.
Figure 3:
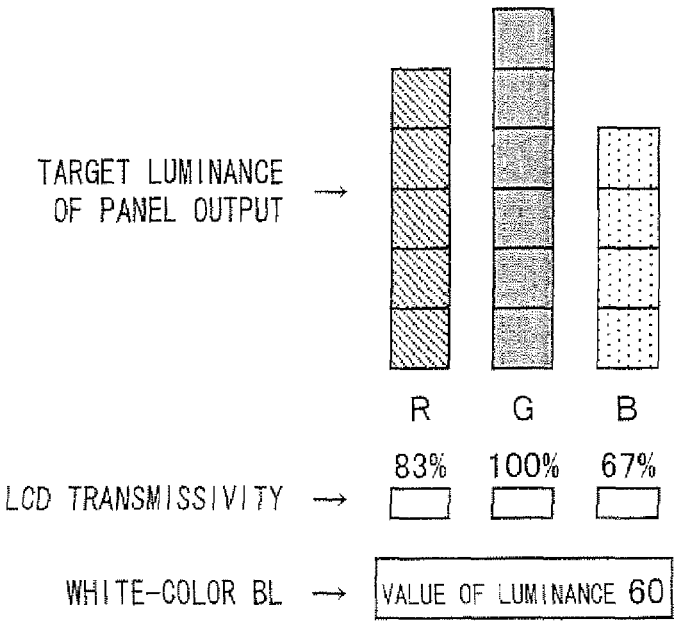

First, the following describes how the backlight value for a pixel where min (Rsi, Gsi, Bsi)≧max (Rsi, Gsi, Bsi)/(1+1/WR) is obtained in the case in which a liquid crystal panel having the white-color luminance ratio WR of 1 is used, with reference to FIGS. 3(*a*) and 3(*b*). FIG. 3(*a*) illustrates how the backlight value is obtained in the present liquid crystal display device. FIG. 3(*b*) is a comparative figure illustrating how the backlight value is obtained in Publication No. 65531/1999.

The following discusses the case in which a target luminance of a panel output of a target pixel is (R, G, B)=(50, 60, 40) in FIGS. 3(*a*) and 3(*b*). In this case, 60 which is the luminance of G is max (Rsi, Gsi, Bsi), 40 which is the luminance of B is min (Rsi, Gsi, Bsi), and the following relationship is satisfied $$\min(Rsi, Gsi, Bsi)\geqq\max(Rsi, Gsi, Bsi)/(1+1/WR).$$

In the display method of Publication No. 65531/1999, the backlight value is set to max (Rsi, Gsi, Bsi)=60, and the respective transmissivities of the subpixels are determined according to the backlight value as shown in FIG. 3(*b*). Specifically, the transmissivities of the subpixels R, G, B are set to 83% (=50/60), 100% (=60/60) and 67% (=40/60), respectively.

On the other hand, in the present liquid crystal display device, some of the respective components R, G, B of the input signals Rsi, Gsi, Bsi are transferred to the transmission amount of the component W by the amount that corresponds to max (Rsi, Gsi, Bsi)/(1+1/WR). As a result, the input signal (R, G, B)=(50, 60, 40), which is expressed by the RGB signal, is converted into the transmission amount (R, G, B, W)=(20, 30, 10, 30), which is expressed by the RGBW signal. Further, the backlight value for the target pixel is set to max (Rsi, Gsi, Bsi)/(1+WR) 30. Further, the respective transmissivities of the subpixels R, G, B, W are determined according to the backlight value. Specifically, the transmissivities of the subpixels R, G, B, W are set to 67% (=20/30), 100% (=30/30), 33% (=10/30), and 100% (=30/30/WR), respectively. It should be noted that the transmissivities shown in FIG. 3(*a*) are exemplary transmissivities in the case in which the backlight value obtained for the target pixel is the highest value among the plural backlight values obtained for all pixels and is adopted as the luminance of the backlight.

Further, in order to make it possible to compare the backlight value in the present liquid crystal display device with the backlight value obtained by the method of Publication No. 65531/1999, an area ratio of the subpixels also needs to be considered. A single pixel is divided into three subpixels in Publication No. 65531/1999, whereas a single pixel is divided into four subpixels in the present liquid crystal display device. Thus, if it is assumed that the pixel is divided into equal subpixels, the area of each subpixel in the present liquid crystal display device is only 3/4 of that in Publication No. 65531/1999. To make up for this reduction in area of the subpixel, the backlight value is multiplied by 4/3 in the present liquid crystal display device so that it becomes possible to compare the backlight value with that of Publication No. 65531/1999 by a common standard.

Accordingly, correcting the backlight value in FIG. 3(*a*) so as to have the same standard as that of the backlight value of FIG. 3(*b*) brings (4/3)×60/(1+WR)=40. The backlight value in FIG. 3(*b*), in which similar displaying is carried out, is 60. It is apparent therefrom that the present invention produces the effect of reduction in power consumption of the target pixel.

Figure 4:
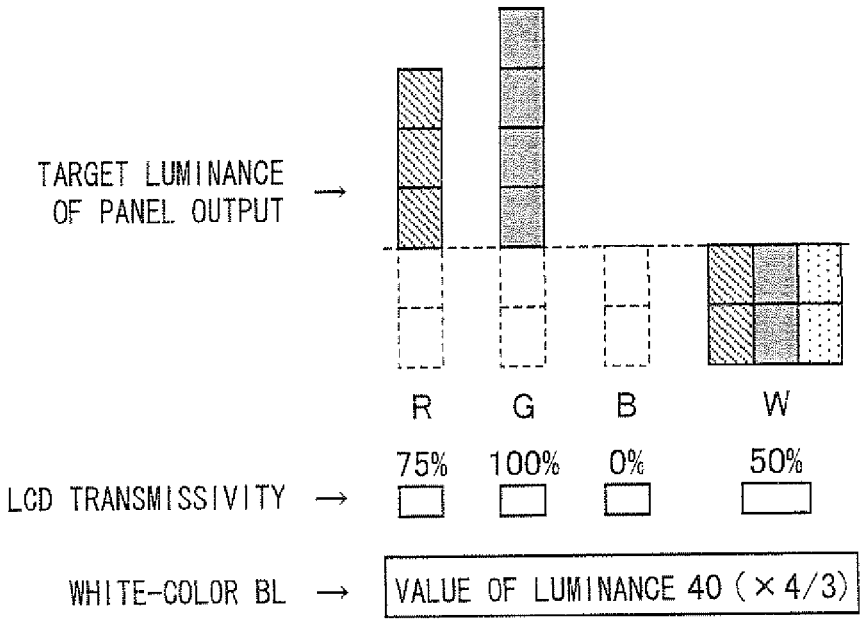
FIG. 4(*a*) is a figure illustrating how a backlight value is obtained in the liquid crystal display device.
Figure 4:
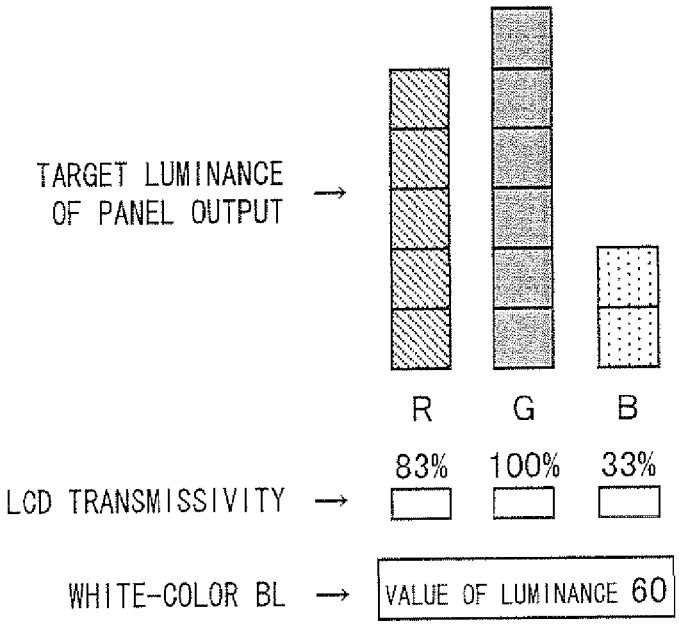

The following describes how the backlight value for a pixel where min (Rsi, Gsi, Bsi)<max (Rsi, Gsi, Bsi)/(1+1/WR) is obtained in the case in which the liquid crystal panel having the white-color luminance ratio WR of 1 is used, with reference to FIGS. 4(*a*) and 4(*b*). FIG. 4(*a*) is illustrates how the backlight value is obtained in the present liquid crystal display device. FIG. 4(*b*) is a comparative figure illustrating how the backlight value is obtained in Publication No. 65531/1999.

The following discusses the case in which the target luminance of the panel output of the target pixel is (R, G, B)=(50, 60, 20) in FIGS. 4(*a*) and 4(*b*). In this case, 60 which is the luminance of G is max (Rsi, Gsi, Bsi), 20 which is the luminance of B is min (Rsi, Gsi, Bsi), and the following relationship is satisfied $$\min(Rsi, Gsi, Bsi) < \max(Rsi, Gsi, Bsi)/(1+1/WR).$$

In the display method of Publication No. 65531/1999, the backlight value is set to max (Rsi, Gsi, Bsi)=60, and the respective transmissivities of the subpixels are determined according to the backlight value as shown in FIG. 4(*b*). Specifically, the transmissivities of the subpixels R, G, B are set to 83% (=50/60), 100% (=60/60), and 33% (=20/60), respectively.

On the other hand, in the present liquid crystal display device, some of the respective components R, G, B of the input signals Rsi, Gsi, Bsi are transferred to the transmission amount of the component W by the amount that corresponds to min (Rsi, Gsi, Bsi). As a result, the input signal (R, G, B)=(50, 60, 20), which is expressed by the RGB signal, is converted into the transmission amount (P, G, B, W)=(30, 40, 0, 20), which is expressed by the RGBW signal. Further, the backlight value for the target pixel is set to (max (Rsi, Gsi, Bsi)−min (Rsi, Gsi, Bsi))=40. Further, the respective transmissivities of the subpixels R, G, B, W are determined according to the backlight value. Specifically, the transmissivities of the subpixels R, G, B, W are set to 75% (=30/40), 100% (=40/40), 0% (=0/40) and 50% (=20/40/WR), respectively.

It should be noted that the transmissivities shown in FIG. 4(*a*) are exemplary transmissivities in the case in which the backlight value obtained for the target pixel is the highest value among the plural backlight values obtained for all pixels and is adopted as the luminance of the backlight. Further, the backlight value is multiplied by 4/3 also in the case shown in FIG. 4(*a*) in order to make it possible to compare the backlight value with that of Publication No. 65531/1999 by a common standard.

Accordingly, the backlight value in the case shown in FIG. 4(*a*) becomes (4/3)×(60−20)=53.3. The backlight value in FIG. 4(*b*), in which similar displaying is carried out, is 60. It is apparent therefrom that the present invention produces the effect of reduction in power consumption in the target pixel.

Figure 15:
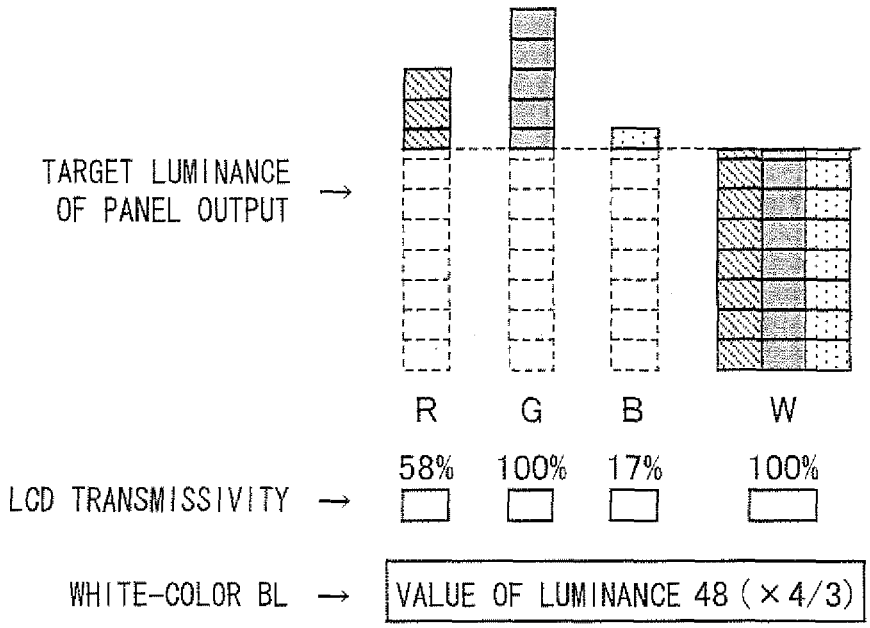
FIG. 15(*a*) is a figure illustrating how the backlight value is obtained in the liquid crystal display device.
Figure 15:
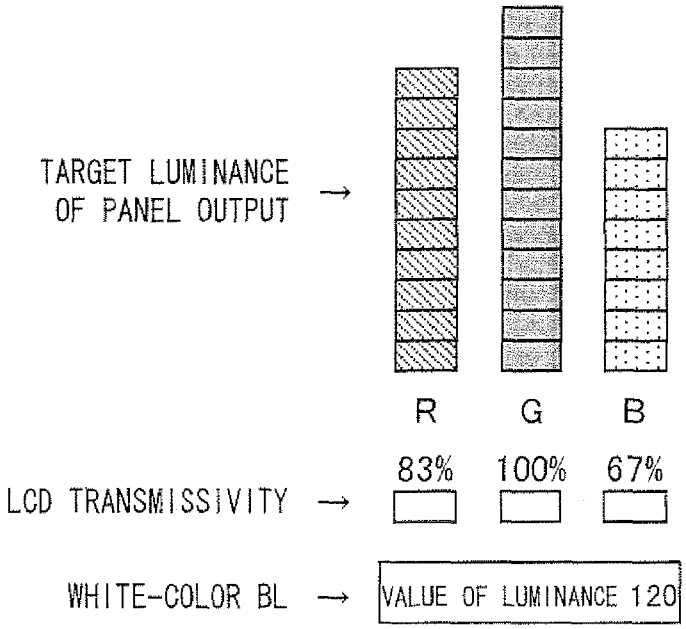

The following describes how the backlight value for a pixel where min (Rsi, Gsi, Bsi)≧max (Rsi, Gsi, Bsi)/(1+1/WR) is obtained in the case in which a liquid crystal panel having the white-color luminance ratio WR of 1.5 is used, with reference to FIGS. 15(*a*) and 15(*b*). FIG. 15(*a*) illustrates how the backlight value is obtained in the present liquid crystal display device. FIG. 15(*b*) is a comparative figure illustrating how the backlight value is obtained in Publication No. 65531/1999.

The following discusses the case in which the target luminance of the panel output of the target pixel is (R, G, B)=(100, 120, 80) in FIGS. 15(*a*) and 15(*b*). In this case, 120 which is the luminance of G is max (Rsi, Gsi, Bsi), 80 which is the luminance of B is min (Rsi, Gsi, Bsi), and the following relationship is satisfied $$\min(Rsi, Gsi, Bsi) \geqq \max(Rsi, Gsi, Bsi)/(1+1/WR)=72.$$

In the display method of Publication No. 65531/1999, the luminance of the backlight is set to max (Rsi, Gsi, Bsi)=120 as shown in FIG. 15(*b*), and the respective transmissivities of the subpixels are determined according to the backlight value. Specifically, the transmissivities of the subpixels R, G, B are set to 83% (=100/120), 100% (=120/120) and 67% (=80/120), respectively.

On the other hand, in the present liquid crystal display device, some of the respective components R, G, B of the input signals Rsi, Gsi, Bsi are transferred to the transmission amount of the component W by the amount that corresponds to max (Rsi, Gsi, Bsi)/(1+1/WR). As a result, the input signal (R, G, B)=(100, 120, 80), which is expressed by the RGB signal, is converted into the transmission amount (R, G, B, W)=(28, 48, 8, 72), which is expressed by the RGBW signal. Further, the backlight value for the target pixel is set to max (Rsi, Gsi, Bsi)/(1+WR)=48.

The respective transmissivities of the subpixels R, G, B, W are determined according to brightness of the backlight, which brightness is produced on the basis of the backlight value. Further, since the subpixel W is brighter than the subpixels RGB by the white-color luminance ratio WR, the backlight value necessary for the transmission-amount of the subpixel W is calculable by multiplying the backlight value necessary for the subpixels RGB by 1/WR. The transmissivities of the subpixels R, G, B, W are set to 58% (=28/48), 100% (=48/48), 16.7% (8/48) and 100% (=72/48/WR), respectively.

It should be noted that the tansmissivities shown in FIG. 15(*a*) are exemplary transmissivities in the case in which the backlight value obtained for the target pixel is the highest value among the plural backlight values obtained in all pixels and is adopted as the luminance of the backlight. In the case shown in FIG. 15(*a*), the luminance of the backlight is multiplied by 4/3 so that it becomes possible to compare the backlight value with that of Publication No. 65531/1999 by a common standard.

Accordingly, correcting the backlight value in FIG. 15(*a*) so as to have the same standard as that of the backlight value of FIG. 15(*b*) brings (4/3)×48=64. The backlight value in FIG. 15(*b*), in which similar displaying is carried out, is 120. It is apparent therefrom that the present invention produces the advantage of reduction in power consumption of the target pixel.

Figure 16:
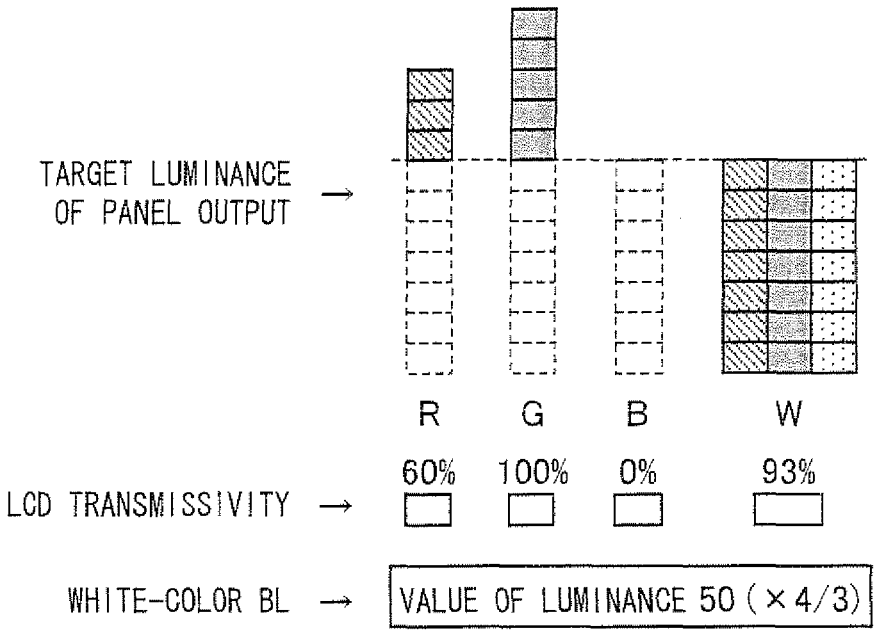
FIG. 16(*a*) is a figure illustrating how the backlight value is obtained in the liquid crystal display device.
Figure 16:
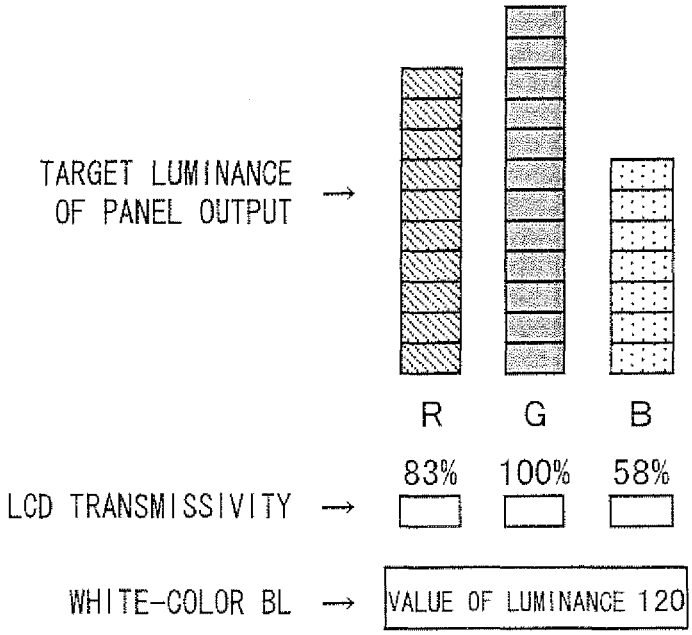

The following describes how the backlight value for a pixel where min (Rsi, Gsi, Bsi)<max (Rsi, Gsi, Bsi)/(1+1/WR) is obtained in the case in which the liquid crystal display panel having the white-color luminance ratio WR of 1.5 is used, with reference to FIGS. 16(*a*) and 16(*b*). FIG. 16(*a*) illustrates how the backlight value is obtained in the present liquid crystal display device. FIG. 16(*b*) is a comparative figure illustrating how the backlight value is obtained in Publication No. 65531/1999.

The following discusses the case in which the target luminance of the panel output of the target pixel is (R, G, B)=(100, 120, 70) in FIGS. 16(*a*) and 16(*b*). In this case, 120 which is the luminance of G is max (Rsi, Gsi, Bsi), 70 which is the luminance of B is min (Rsi, Gsi, Bsi), and the following relationship is satisfied $$\min(Rsi, Gsi, Bsi)<\max(Rsi, Gsi, Bsi)/(1+1/WR).$$

In the display method of Publication No. 65531/1999, the backlight value is set to max (Rsi, Gsi, Bsi)=120, and the respective transmissivities of the subpixels are determined according to the backlight value as shown in FIG. 16(*b*). Specifically, the transmissivities of the subpixels R, G, B are set to 83% (=100/120), 100% (=120/120), and 58% (=70/120), respectively.

On the other hand, in the present liquid crystal display device, some of the respective components R, G, B of the input signals Rsi, Gsi, Bsi are transferred to the transmission amount of the component W by the amount that corresponds to min (Rsi, Gsi, Bsi). As a result, the input signal (R, G, B)=(100, 120, 70), which is expressed by the RGB signal, is converted into the transmission amount (R, G, B, W)=(30, 50, 0, 70), which is expressed by the RGBW signal. Further, the backlight value for the target pixel is set to max (Rsi, Gsi, Bsi)−min (Rsi, Gsi, Bsi))=50. Further, the respective transmissivities of the subpixels R, G, B, W are set to 60% (=30/50), 100% (=50/50), 0% (=0/50), and 93% (=70/50/WR), respectively.

It should be noted that the transmissivities shown in FIG. 16(*a*) are exemplary transmissivities in the case in which the backlight value obtained for the target pixel is the highest value among the plural backlight values obtained for all pixels and is adopted as the luminance of the backlight. Further, in the case shown in FIG. 16(*a*), the luminance of the backlight is multiplied by 4/3 in order to make it possible to compare the backlight value with that of Publication No. 65531/1999 by a common standard.

Accordingly, the backlight value in the case shown in FIG. 16(*a*) becomes (4/3)×(120−70)=66.7. The backlight value in FIG. 16(*b*), in which similar displaying is carried out, is 120. It is apparent therefrom that the present invention produces the effect of reduction in power consumption of the target pixel.

Figure 17:
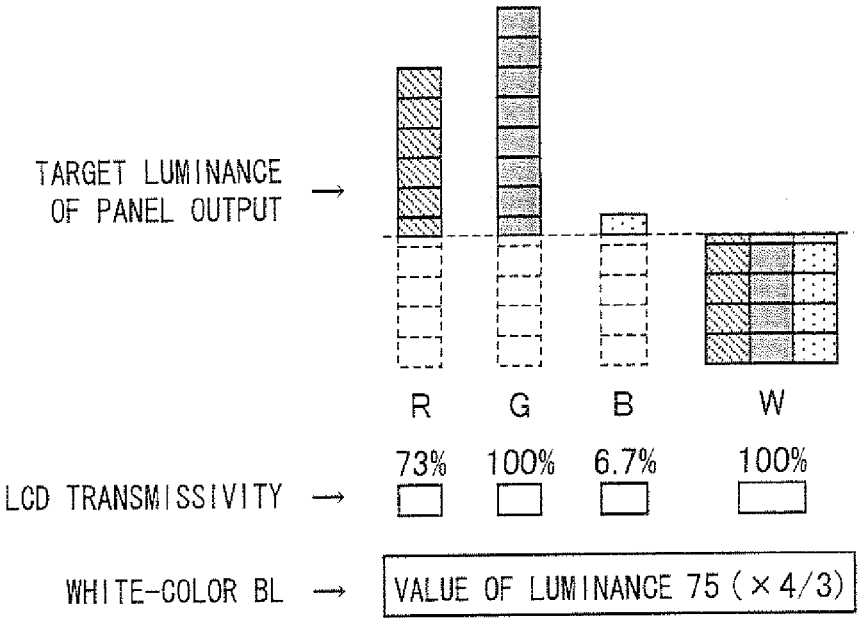
FIG. 17(*a*) is a figure illustrating how the backlight value is obtained in the liquid crystal display device.
Figure 17:
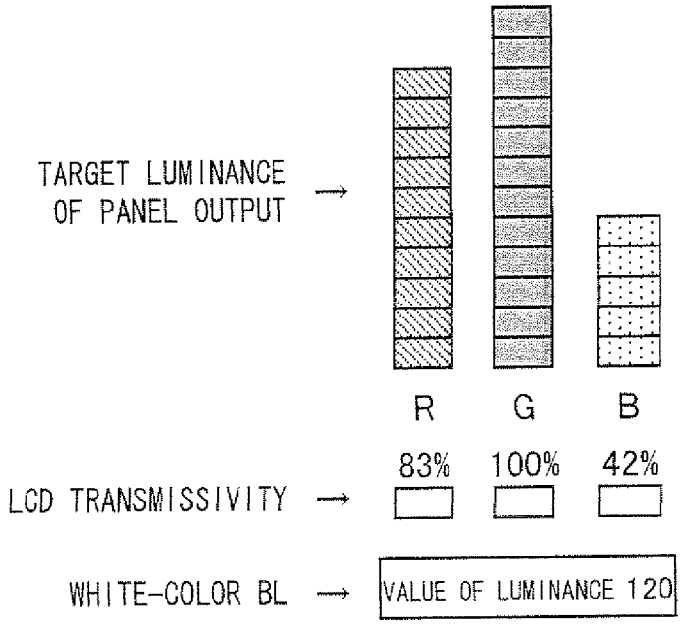

The following describes how the backlight value for a pixel where min (Rsi, Gsi, Bsi)≧max (Rsi, Gsi, Bsi)/(1+1/WR) is obtained in the case in which a liquid crystal panel having the white-color luminance ratio WR of 0.6 is used, with reference to FIGS. 17(*a*) and 17(*b*). FIG. 17(*a*) illustrates how the backlight value is obtained in the present liquid crystal display device. FIG. 17(*b*) is a comparative figure illustrating how the backlight value is obtained in Publication No. 65531/1999.

The following discusses the case in which the target luminance of the panel output of the target pixel is (R, G, B)=(100, 120, 50) in FIGS. 17(*a*) and 17(*b*). In this case, 120 which is the luminance of G is max (Rsi, Gsi, Bsi), 50 which is the luminance of B is min (Rsi, Gsi, Bsi), and the following relationship is satisfied $$\min(Rsi, Gsi, Bsi)\geqq\max(Rsi, Gsi, Bsi)/(1+1/WR)=45.$$

In the display method of Publication No. 65531/1999, the luminance of the backlight is set to max (Rsi, Gsi, Bsi)=120 as shown in FIG. 17(*b*), and the respective transmissivities of the subpixels are determined according to the backlight value. Specifically, the transmissivities of the subpixels R, G, B are set to 83% (=100/120), 100% (=120/120), and 42% (=50/120), respectively.

On the other hand, in the present liquid crystal display device, some of the respective components R, G, B of the input signals Rsi, Gsi, Bsi are transferred to the transmission-amount of the component W by the amount that corresponds to max (Rsi, Gsi, Bsi)/(1+1/WR). As a result, the input signal (R, G, B)=(100, 120, 50), which is expressed by the RGB signal, is converted into the transmission amount (R, G, B, W)=(55, 75, 5, 45), which is expressed by the RGBW signal. Further, the backlight value for the target pixel is set to max (Rsi, Gsi, Bsi)/(1+WR)=75. The respective transmissivities of the subpixels R, G, B, W are set to 73% (=55/75), 100% (=75/75), 6.7% (=5/75), and 100% (=45/75/WR), respectively.

It should be noted that the transmissivities shown in FIG. 17(*a*) are exemplary transmissivities in the case in which the backlight value obtained for the target pixel is the highest value among the plural backlight values obtained for all pixels and is adopted as the luminance of the backlight. In the case shown in FIG. 17(*a*), the luminance of the backlight is multiplied by 4/3in order to make it possible to compare the backlight value with that of Publication No. 65531/1999 by a common standard.

Accordingly, correcting the backlight value in FIG. 17(*a*) so as to have the same standard as that of the backlight value of FIG. 17(*b*) brings (4/3)×75=100. The backlight value in FIG. 17(*b*), in which similar displaying is carried out, is 120. It is apparent therefrom that the present invention produces the effect of reduction in power consumption of the target pixel.

Figure 18:
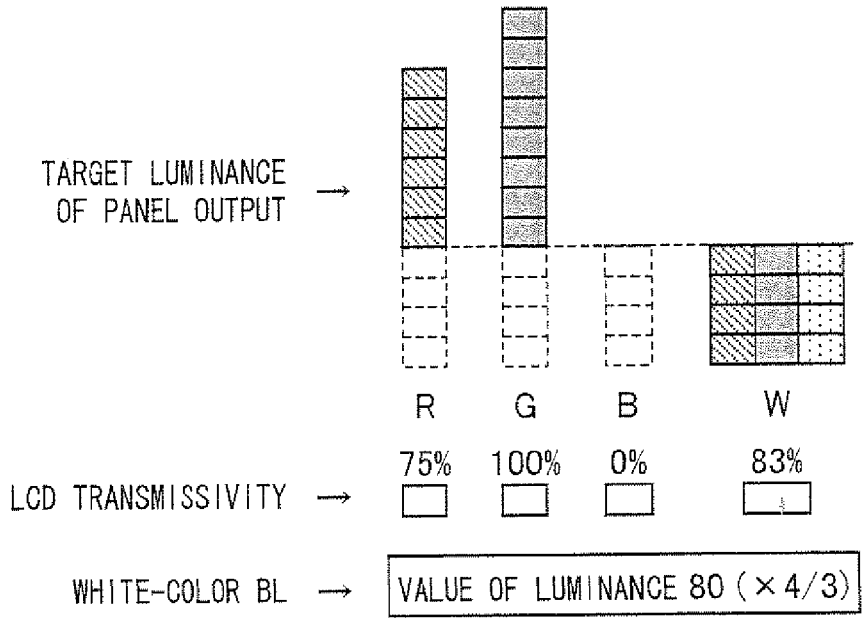
FIG. 18(*a*) is a figure illustrating how the backlight value is obtained in the liquid crystal display device.
Figure 18:
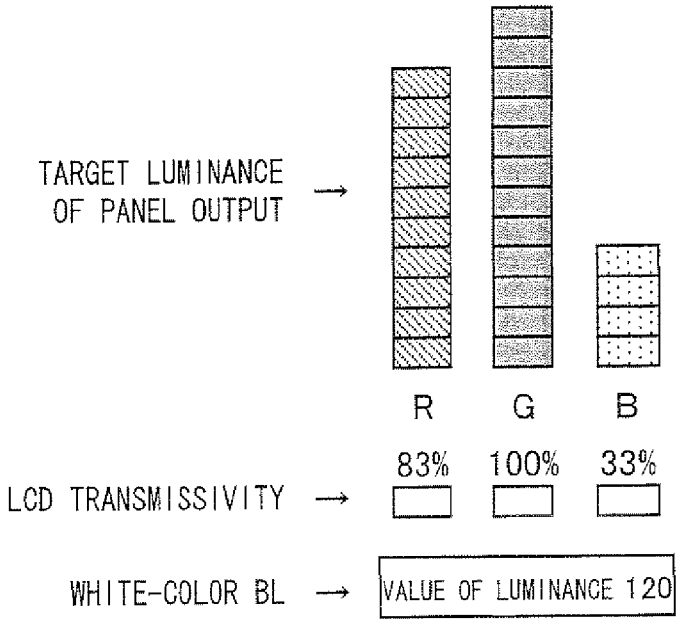

The following describes how the backlight value for a pixel where min (Rsi, Gsi, Bsi)<max (Rsi, Gsi, Bsi)/(1+1/WR) is obtained in the case in which the liquid crystal panel having the white-color luminance ratio WR of 0.6 is used, with reference to FIGS. 18(*a*) and 18(*b*). FIG. 18(*a*) illustrates how the backlight value is obtained in the present liquid crystal display device. FIG. 18(*b*) is a comparative figure illustrating how the backlight value is obtained in Publication No. 65531/1999.

The following discusses the case in which the target luminance of the panel output of the target pixel is (R, G, B) (100, 120, 40) in FIGS. 18(*a*) and 18(*b*). In this case, 120 which is the luminance of G is max (Rsi, Gsi, Bsi), 40 which is the luminance of B is min (Rsi, Gsi, Bsi), and the following relationship is satisfied $$\min(Rsi, Gsi, Bsi)<\max(Rsi, Gsi, Bsi)/(1+1/WR).$$

In the display method of Publication No. 65531/1999, the backlight value is set to max (Rsi, Gsi, Bsi)=120 as shown in FIG. 18(*b*), and the respective transmissivities of the subpixels are determined according to the backlight value. Specifically, the transmissivities of the subpixels R, G, B are set to 83% (=100/120), 100% (=120/120) and 33% (=40/120), respectively.

On the other hand, in the present liquid crystal display device, some of the respective components R, G, B of the input signals Rsi, Gsi, Bsi are transferred to the transmission amount of the component W by the amount that corresponds to min (Rsi, Gsi, Bsi). As a result, the input signal (R, G, B)=(100, 120, 40), which is expressed by the RGB signal, is converted into the output signal (R, G, B, W)=(60, 80, 0, 40), which is expressed by the RGBW signal. Further, the backlight value for the target pixel is set to max (Rsi, Gsi, Bsi) min (Rsi, Gsi, Bsi))=80. Further, the transmissivities of the subpixels R, G, B, W are set to 75% (=60/80), 100% (=80/80), 0% (=0/80) and 83% (=40/80/WR), respectively.

It should be noted that the transmissivities shown in FIG. 18(*a*) are exemplary transmissivities in the case in which the backlight value obtained for the target pixel is the highest value among the plural backlight values obtained for all pixels and is adopted as the backlight value for the backlight. In the case shown in FIG. 18(*a*), the luminance of the backlight is multiplied by 4/3 in order to make it possible to compare the backlight value with that of Publication No. 65531/1999 by a common standard.

Accordingly, the backlight value in the case shown in FIG. 18(*a*) becomes (4/3)×(120−40)=107. The backlight value in FIG. 18(*b*), in which similar displaying is carried out, is 120. It is apparent therefrom that the present invention produces the effect of reduction in power consumption of the target pixel.

FIGS. 3, 4, and 15 to 18 illustrate how the minimum necessary backlight value is obtained for each pixel. In accordance with the foregoing method, the minimum necessary backlight value is obtained for each of the pixels within the display area corresponding to the backlight. The highest value among the plural backlight values thus obtained is determined as the luminance of the backlight.

The following describes how the backlight value and the transmissivities of the subpixels are determined in accordance with the above-described method in the present liquid crystal display device, with reference to FIGS. 5(*a*) to 5(*e*).

FIG. 5(*a*) illustrates the input signals (Rsi, Gsi, Bsi) of the display area that corresponds to the backlight. To make the description simple, let the white-color luminance ratio WR be 1, and let the display area be constituted of four pixels A to D. The actual white-color luminance ratio WR is determined according to the liquid crystal panel, is a common value for the all pixel, and is greater than 0.

FIG. 5(*b*) shows the results of converting the input signals (Rsi, Gsi, Bsi) into the output signals (Rtsi, Gtsi, Btsi, Wtsi), which are expressed by the RGBW signals, in the respective pixels A to D. Further, the backlight values obtained for the respective pixels are as shown in FIG. 5(*c*). The highest one of the plural backlight values obtained for the respective pixels is determined as the backlight value. That is to say, 100 is determined as the backlight value.

The transmissivities (rsi, gsi, bsi, wsi) of the respective pixels with respect to the backlight value of 100 thus determined are obtained on the basis of the values of the output signals (Rtsi, Gtsi, Btsi, Wtsi) shown in FIG. 5(*b*). The results thereof are as shown in FIG. 5(*d*). The final display-luminances of the respective pixels are as shown in FIG. 3(*e*). It is confirmed therefrom that the final display-luminances match the luminances of the input signals (Rsi, Gsi, Bsi) shown in FIG. 5(*a*).

As the foregoing describes, in the process of calculating the backlight value and the transmissivities of the subpixels by the output signal generating section 12, the subpixel W shares the amount of light of the white component so that absorption of the light by the color filter is restrained, whereby power consumption of the backlight 16 is reduced. Thus, transferability of the amount of light of the white component to the subpixel W in display image data is necessary in order to produce this effect of reduction in power consumption of the backlight.

If the greater amount of light of the white component is to be transferred to the subpixel W of every pixel within the display area corresponding to the backlight (i.e. color saturation is low), the process of calculating the backlight value and the transmissivities of the subpixels by the output signal generating section 12 produces a greater effect of reduction in power consumption of the backlight. On the other hand, if the display area corresponding to the backlight contains a pixel with a subpixel W to which the lower amount of light of the white component is to be transferred (i.e. color saturation is high), the effect of reduction in power consumption of the backlight is low. In this case, if the luminance is high, the power consumption may even increase, compared with the display method of Publication No. 65531/1999.

The following describes the way to determine the backlight value for two pixels that are same in luminance and different in color saturation, in the case in which the liquid crystal panel having the white-color luminance ratio WR of 1 is used.

In the case of pixel A (luminance=208, color saturation=0.533) of (R, G, B)=(176, 240, 112), the backlight value is calculated as follows.

In the pixel A, the amount of light that is to be transferred to the subpixel W is (112). The respective amounts of light in the subpixels R, G, B after subtraction of the amount of light that is to be transferred to the subpixel W become (64, 128, 0). Accordingly, (128) is determined as the backlight value for the pixel A.

In the case of pixel B (luminance 208, color saturation=0.75) of (R, G, B)=(160, 256, 64), the backlight value is calculated as follows.

In the pixel B, the amount of light that is to be transferred to the subpixel W is (64). The respective amounts of light in the subpixels R, G, B after subtraction of the amount of light that is to be transferred to the subpixel W become (96, 192, 0). Accordingly, (192) is determined as the backlight value for the pixel B.

In comparison of the pixel A with the pixel B, although the pixel A and the pixel B are same in luminance, the higher backlight value is determined for the pixel B, which is higher in color saturation. This indicates that the effect of reduction in power consumption of the backlight is low.

The output signal generating section 12 can use the process also to calculate the backlight value and the transmissivities of original image data (i.e. first KGB input signal) that is originally supplied to the present liquid crystal display device. However, in the foregoing case, the effect of reduction in power consumption is not always achieved in every image because of the reasons mentioned above (note that, in reality, the effect of reduction in power consumption is achieved in many cases in common halftone-display screens that are considered to have the most occasion to be displayed).

Thus, the color-saturation reducing section 11 is provided before the output signal generating section 12 in the present liquid crystal display device, whereby the process of reducing color saturation is carried out on the first RGB input signal to convert the first KGB input signal into the second RGB input signal. This makes it possible to achieve the effect of reduction in power consumption of the backlight more reliably and significantly in the process carried out in the output signal generating section 12. The following describes in detail the process of reducing color saturation, which process is carried out in the color-saturation reducing section 11.

Figure 6:
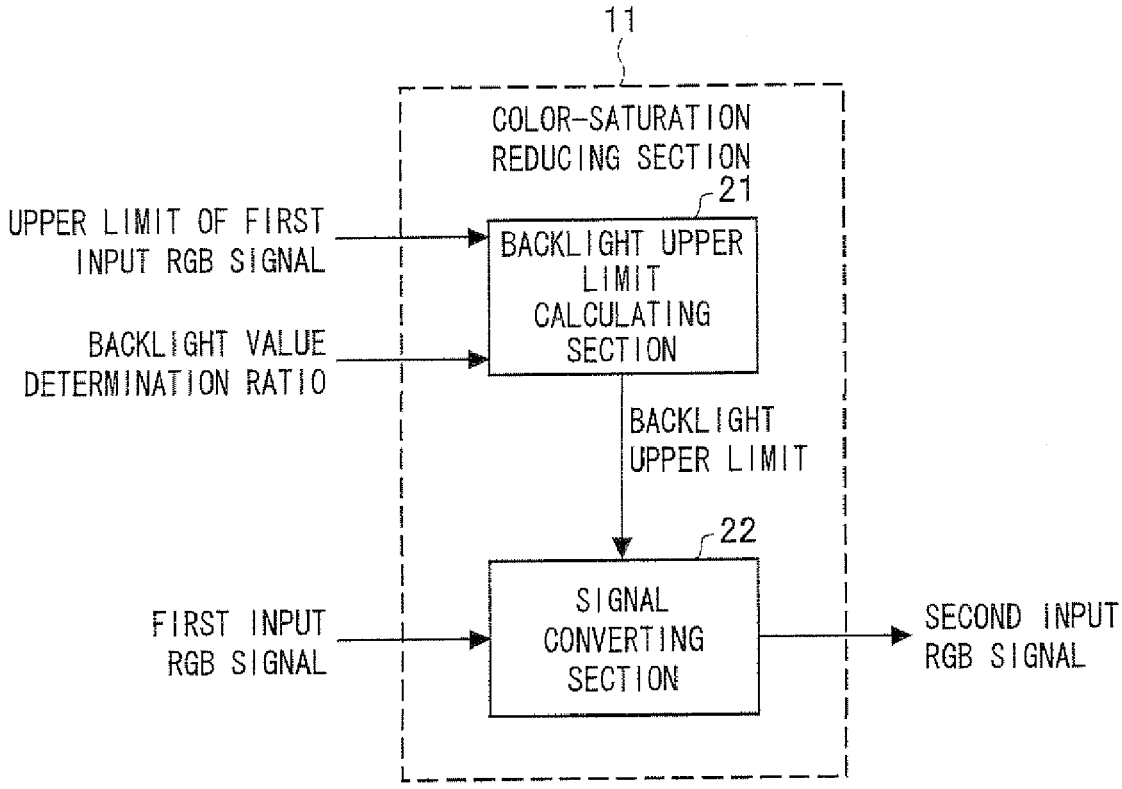
FIG. 6 is a block diagram illustrating an exemplary configuration of a color-saturation reducing section in the liquid crystal display device.

FIG. 6 is a block diagram illustrating a schematic configuration of the color-saturation reducing section 11. As shown in FIG. 6, the color-saturation reducing section 11 includes a backlight upper limit calculating section 21 and a signal converting section 22. The backlight upper limit calculating section 21 calculates an upper limit of the backlight on the basis of an upper limit of the first RGB input signal, the white-color luminance ratio WR, and the backlight value determination ratio. The backlight upper limit calculating section 21 supplies the upper limit of the backlight to the signal converting section 22. The signal converting section 22 calculates the second RGB input signal on the basis of the first RGB input signal and the upper limit of the backlight, which upper limit is supplied from the backlight upper limit calculating section 21. The signal converting section 22 outputs the second RGB input signal.

Figure 7:
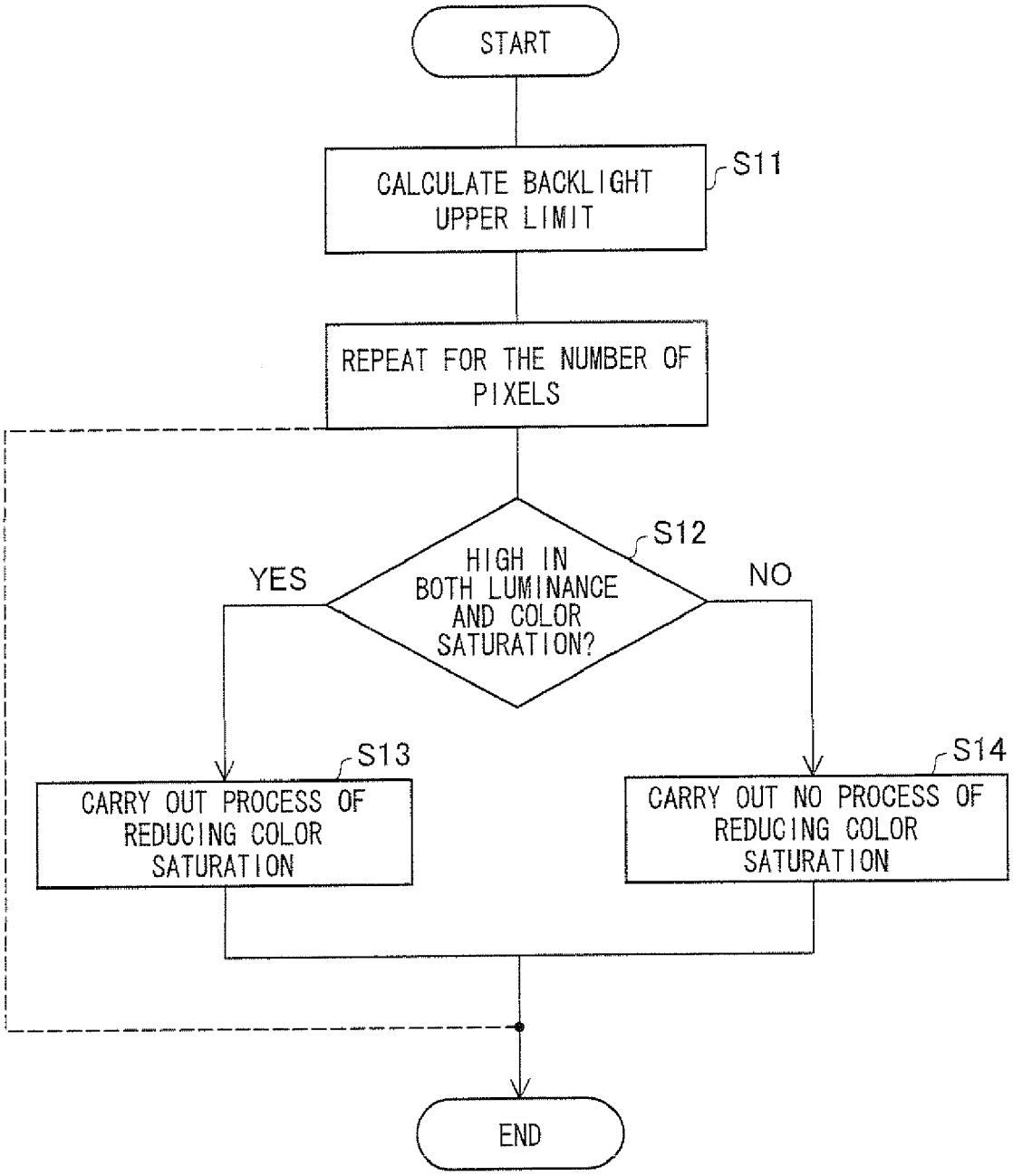
FIG. 7 is a flowchart illustrating a sequence of operation of the color-saturation reducing section operates.

FIG. 7 is a flowchart showing the operation of the color-saturation reducing section 11.

In S11 the upper limit of the backlight is calculated in the backlight upper limit calculating section 21 (S11). The color-saturation reducing section 11 carries out the process of reducing color saturation only on the pixels having a high luminance and the low amount of light transferable to the subpixel W (i.e. color saturation is high). The color-saturation reducing section 11 does not carry out the process of reducing color saturation on the pixels that are low in at least one of color saturation or luminance. The followings are reasons therefor. Regarding the pixels that are low in color saturation, the backlight value can be reduced significantly by transferring a larger amount of light to the subpixel W, even if the luminance is high. Further, in the first place, the pixels that are low in luminance do not need a high backlight value for display. The upper limit of the backlight is used to determine the pixels on which the process of reducing color saturation needs to be carried out. The following describes in detail the process of calculating the upper limit of the backlight.

First, the following discusses the case in which no process of reducing color saturation is to be carried out on image data (i.e. RGB input signal), and in which the backlight value becomes highest. In this case, there exists a pixel having the color saturation of 1 (the amount of light is not transferable to the subpixel W) and having RGB values at least one of which is MAX (indicating the upper limit of the RGB input signal). The backlight value at this time also becomes MAX.

Next, the following discusses the case in which the process of reducing color saturation is to be carried out on image data (i.e. RGB input signal), and in which the backlight value becomes highest. The process of reducing color saturation in this case is a process by which the color saturation becomes minimum without changing the luminance of the pixels, to which the process is carried out, before and after the process. In this case, the backlight value becomes maximum when there exists a pixel having the color saturation of 0 (the color saturation is not reducible any further, and therefore the backlight value is not reducible) and having the RGB values that are all MAX. The subpixel W shines WR times brighter than the subpixels RGB do. Thus, the most efficient backlight is achieved by transferring the amount of light of WR/(1+WR) of the respective RGB values to the subpixel W and the amount of light of 1/(1+WR) of the respective RGB values to the respective subpixels RGB in the pixels. The backlight value at this time is MAX/(1+WR).

Accordingly, the range of the upper limit MAXw of the backlight is from MAX/(1+WR) to MAX. The upper limit MAXw of the backlight is expressed by Formula (1) below $$\mathrm{MAX}w=\mathrm{MAX}\times Bl\ \mathrm{Ratio} \tag{1}$$

where the range of Bl Ratio is from 1/(1+WR) to 1.0.

It should be noted that MAX mentioned here indicates the upper limit of the KGB input signal. MAX may not be a single value and may be plural values. In other words, the lower limit of MAX is a highest value (MAXi) of all KGB values of the RGB input signal. The reason therefor is that setting MAX lower than MAXi makes it impossible to set the backlight value to a desired value. On the other hand, the upper limit of MAX is a highest value (MAXs) that the KGB input signal can possibly take. The reason therefor is that there is no case in which MAX that is greater than MAXs is needed.

MAXs is expressed as $$\mathrm{MAX}s=2^{Bw}-1,$$

where Bw is a bit width of the RGB input signal. For example if Bw is 8, MAXs is calculated as $2^8-1=255$. Accordingly, the effective range of MAX is expressed as $$\mathrm{MAXi}\leqq\mathrm{MAX}\leqq\mathrm{MAXs}.$$

Any value may be determined as MAX, as long as the value satisfies MAXi≦MAX≦MAXs. Setting MAX=MAXi makes it possible to reduce the backlight value most significantly, but MAX needs to be calculated for each image. On the other hand, setting MAX=MAXs results in a higher backlight upper limit (MAXw) than MAXi. Setting MAX=MAXs also results in MAX being a constant that does not depend on the image, and therefore MAX does not need to be calculated for each image.

The Bl Ratio in Formula (1) above is a constant that denotes the level of the process of reducing color saturation. Specifically, the Bl Ratio of 1 corresponds to the case in which no process of reducing color saturation is to be carried out, and the Bl Ratio of 1/(1+WR) corresponds to the case in which the process is to be carried out in such a way as to make the color saturation minimum. In the process of reducing color saturation, the more the color saturation is reduced, the more the effect of reduction in power consumption of the backlight improves, but, naturally, the degree of deterioration in image quality as a result of the reduction in color saturation increases. Thus, the Bl Ratio may be arbitrarily determined within the range of 1/(1+WR) to 1 according to the level of the reduction in color saturation, in consideration of the balance between the effect of reduction in power consumption and the deterioration in image quality.

Once the upper limit MAXw of the backlight is determined accordingly, it is then determined in S12, for each pixel, whether or not the process of reducing color saturation is to be carried out, on the basis of Formula (2) below $$\mathrm{MAX}w<\max RGB-\min RGB \tag{2}$$

Note that $$\max RGB=\max(Ri,\ Gi,\ Bi)$$

and $$\min RGB=\min(Ri,\ Gi,\ Bi)$$

in Formula (2) above.

If the RGB values of the target pixel satisfy Formula (2) above, then the target pixel is determined as the pixel that is high in luminance and in color saturation and therefore brings a consequence that the backlight value exceeds the backlight upper limit MAXw if the target pixel remains as the way it is. Therefore, the process of reducing color saturation is carried out on the pixel in S13.

The process of reducing color saturation causes the input image to deteriorate in image quality in terms of vividness of colors. However, general images contain not so many portions that are high in luminance and in color saturation. Thus, in many cases, only limited portions of the images decrease in saturation. Further, human visual features are not so sensitive to the changes in color, compared with those to the changes in brightness. Thus, in many cases, deterioration in image quality as a result of reduction in color saturation is difficult for humans to recognize. On the other hand, human visual features recognize the changes in luminance as significant deterioration in image quality. It is therefore important in the process of reducing color saturation to reduce only color saturation without a change in luminance.

On the other hand, a pixel that does not satisfy Formula (2) in S12 is determined as a pixel that is low in luminance or in color saturation and therefore brings a consequence that the backlight value does not exceed the upper limit MAXw of the backlight even if the pixel remains as the way it is. No process of reducing color saturation needs to be carried out on the pixel. Thus, the process moves to S14, and pixel data in the first input RGB data is used in the second input RGB data without being changed.

The following describes why Formula (2) above is used to determine whether or not the process of reducing color saturation needs to be carried out on the target pixel.

First of all, the subpixel-W transmission amount Wti in the case in which no reduction of color saturation is to be carried out is calculated according to Formula (3) below $$Wti=\min(\max RGB/(1+1/WR),\min RGB) \quad (3)$$

Further, the subpixels-RGB transmission amounts (Rti, Gri, Bri) are calculated according to Formulae (4) to (6) below, respectively:

$$Rti=Ri-Wti \quad (4)$$

$$Gti=Gi-Wti \quad (5);$$

and $$Bti=Bi-Wti \quad (6).$$

In Formulae (3) to (6) above, none of the RGBW transmission amounts falls below 0, since Wti does not exceed minRGB.

Formulae (7) to (9) below express conditions under which the RGB transmission amounts do not exceed MAXw, respectively;

$$\mathrm{Rti} \leqq \mathrm{MAXw} \quad (7);$$

$$\mathrm{Gti} \leqq \mathrm{MAXw} \quad (8);$$

and $$\mathrm{Bti} \leqq \mathrm{MAXw} \quad (9).$$

On the other hand, the W transmission amount does not exceed MAXw under a condition that a value obtained by dividing Wti by WR does not exceed MAXw, because the W subpixel shines WR times brighter than the subpixels RGB do. Thus, from Formula (3) above, Formula (10) below is obtained at the end. Specifically, $$Wti/WR \leqq \mathrm{MAX}w$$

and thus $$\min(\max RGB/(1+1/WR), \min RGB) \leqq \mathrm{MAX}w \times WR \quad (10)$$

is obtained. From Formulae (3) to (6) and Formulae (7) to (9), the condition under which none of the RGB transmission-amounts exceeds MAXw is as expressed by Formula (11) below. Specifically, $$\max(Rti, Gti, Bti) \leqq \mathrm{MAX}w$$

and $$\max RGB - Wti \leqq \mathrm{MAX}w$$

and thus $$\max RGB - \min(\max RGB/(1+1/WR), \min RGB) \leqq \mathrm{MAX}w \quad (11)$$

is obtained. The condition under which the W transmission amount does not exceed MAXw in the case (A) in which maxRGB/(1+1/WR)≦minRGB is as follows, from Formula (10) above:

$$\max RGB/(1+1/WR) \leqq \mathrm{MAX}w \times WR$$

and thus $$\max RGB/(1+WR) \leqq \mathrm{MAX}w \quad (12)$$

Further, since MAXw is within the range of MAX/(1+WR)≦MAXw≦MAX, maxRGB/(1+WR)≦MAX/(1+WR)≦MAXw. Thus Formula (12) above is always true.

Next, the condition under which the RGB transmission-amount does not exceed MAXw is as follows, from Formula (11) above, $$\max RGB - \max RGB/(1+1/WR) \leqq \mathrm{MAX}w$$

therefore $$\max RGB/(1+WR) \leqq \mathrm{MAX}w.$$

This formula is identical to Formula (12) above and is therefore always true.

On the other hand, the condition under which the W transmission amount does not exceed MAXw is as follows, from Formula (10), $$\min RGB \leqq \mathrm{MAX}w \times WR.$$

In this case, from MAX/(1+WR)≦MAXw≦MAX and minRGB<maxRGB/(1+1/WR), minRGB<maxRGB/(1+1/WR)=WR×maxRGB/(1+WR)≦WR×MAX/(1+WR)≦MAXw×WR. The formula above is always true.

Next, the condition under which the RGB transmission amounts do not exceed MAXw is as follows, from Formula (11), $$\max RGB - \min RGB \leqq \mathrm{MAX}w \quad (13)$$

Formula (13) above is not always true. Thus, the condition under which none of the RGBW transmission amounts exceeds MAXw is as expressed by Formula (13) above in the case of (B) minRGB<maxRGB/(1+1/WR).

On the other hand, the condition under which at least one of the RGBW transmission-amounts exceeds MAXw is as expressed by Formula (2) above when (B) minRGB<maxRGB/(1+1/WR).

The case in which Formula (2) is true is, from MAX/(1+WR)≦MAXw≦MAX, $$\max RGB/(1+1/WR) \le \mathrm{MAX}/(1+1/WR) = WR \times \mathrm{MAX}/(1+WR) \le \mathrm{MAX}w \times WR < (\max RGB - \min RGB) \times WR$$

and $$\max RGB/(1+1/WR) < (\max RGB - \min RGB) \times WR$$

thus $$\min RGB < \max RGB/(1+1/WR).$$

Therefore, (B) minKGB<maxRGB/(1+1/WR) is always true.

Accordingly, the condition under which at least one of the RGBW transmission amounts exceeds MAXw is as expressed by Formula (2) above unconditionally.

Therefore, if Ri, Gi, and Bi satisfy Formula (2) above, the process of reducing color saturation is carried out so that the backlight value does not exceed MAXw.

The following describes in detail the process of reducing color saturation, which process is carried out on the pixels that are determined high in color saturation and in luminance by Formula (2).

With respect to the pixels that are high in both luminance and color saturation and therefore need the process of reducing color saturation, the signal converting section 22 carries out the process of reducing color saturation on the pixels in accordance with Formulae (16) to (19) below, whereby the first RGB signal (Ri, Gi, Bi) unprocessed is converted into the second RGB signal (Rsi, Gsi, Bsi).

$$Rsi = \alpha \times Ri + (1-\alpha) \times Yi \quad (16);$$

$$Gsi = \alpha \times Gi + (1-\alpha) \times Yi \quad (17);$$

$$Bsi = \alpha \times Bi + (1-\alpha) \times Yi \quad (18);$$

and $$\alpha = \mathrm{MAX}w/(\max RGB - \min RGB) \quad (19).$$

In Formulae (16) to (18) above, Yi is the luminance (e.g. Yi=(2×Ri+5×Gi+Bi)/8) of the RGB input signal (Ri, Gi, Bi).

The following describes how Formulae (16) to (19), all of which are formulae for calculations carried out in the process of reducing color saturation, are derived.

First, formulae for converting the RGB signals to reduce only the color saturation without changing the luminance and the hue are Formulae (16) to (18) where Formula (20) below is satisfied $$0 \leqq \alpha \leqq 1 \quad (20).$$

The following proves that Formulae (16) to (18) above changes neither the luminance nor the hue of the RGB signal before and after the process of reducing color saturation.

First, let (2×R+5×G+B)/8 be the formula for calculating the luminance when the RGB value is (R, G, B). Then, the luminance Ysi after the color saturation is reduced is expressed by Formula (21) below, with respect to the luminance Yi before the color saturation is reduced $$Ysi = (2 \times Rsi + 5 \times Gsi + Bsi)/8 \quad (21).$$

Substituting Formula (21) into Formulae (16) to (18) gives Formula (22) below $$\begin{aligned} Ysi &= \alpha \times (2 \times Ri + 5 \times Gi + Bi)/8 + (1-\alpha) \times Yi \\ &= \alpha \times Yi + (1-\alpha) \times Yi \\ &= Yi. \end{aligned} \quad (22)$$

It is seen from Formula (22) above that the process of reducing color saturation using Formulae (16) to (18) does not change the luminance before and after the process.

Regarding the hue, the case in which the value of R is highest. When the value of R is highest, hueHi before the process of reducing color saturation is as expressed by Formula (23) below $$Hi = (Cb - Cg) \times 60 \quad (23),$$

where $$Cb = (\max RGB - Bi)/(\max RGB - \min RGB)$$

and $$Cg = (\max RGB - Gi)/(\max RGB - \min RGB).$$

Next, the hue Hsi after the process of reducing color saturation becomes as expressed by Formula (24) below $$Hsi = (Cbs - Cgs) \times 60 \quad (24),$$

where $$Cbs = (\max RGBs - Bsi)/(\max RGBs - \min RGBs),$$

$$Cgs = (\max RGBs - Gsi)/(\max RGBs - \min RGBs),$$

$$\max RGBs = \max(Rsi, Gsi, Bsi), \text{ and}$$

$$\min RGBs = \min(Rsi, Gsi, Bsi).$$

Modifying Formula (24) and then substituting Formulae (16) to (18) gives Formula (25) below $$\begin{aligned} His &= \{(\max RGBs - Bsi) - (\max RGBs - Gsi)\}/(\max RGBs - \min RGBs) \times 60 \\ &= \{(Gsi - Bsi)/(\max RGBs - \min RGBs)\} \times 60 \\ &= \alpha \times (Gi - Bi)/\{\alpha \times (\max RGB - \min RGB)\} \times 60 \\ &= \{(Gi - Bi)/(\max RGB - \min RGB)\} \times 60 \\ &= \{(\max RGB - Bi) - (\max RGB - Gi)\}/(\max RGB - \min RGB) \times 60 \\ &= (Cb - Cg) \times 60 \\ &= Hi \end{aligned} \quad (25)$$

It is seen from Formula (25) that the process of reducing color saturation using Formulae (16) to (18) above does not change the hue before and after the process. This is the same in the cases in which the value of G or the value of B is highest.

Then, α that makes the backlight value become the upper limit MAXw of the backlight in Formulae (16) to (18) above is derived.

If all pixels that satisfy Formula (2) are reduced in color saturation in such a manner that $$\mathrm{MAX}w=\max RGBs-\min RGBs$$

is satisfied, the backlight value always becomes equal to or below MAXw. From this formula and Formulae (16) to (18), $$\alpha\times\max RGB+(1-\alpha)\times Yi-\alpha\times\min RGB-(1-\alpha)\times Yi=\mathrm{MAX}w$$

and $$\alpha\times(\max RGB-\min RGB)=\mathrm{MAX}w$$

and thus $$\alpha=\mathrm{MAX}w/(\max RGB-\min RGB)$$

Accordingly, carrying out the process according to the foregoing descriptions, the color-saturation reducing section 11 converts the first RGB input signal into the second KGB input signal, which is to be supplied to the output signal generating section 12 provided subsequently to the color-saturation reducing section 11. The second RGB input signal is a signal formed by converting pixel data in the first RGB input signal, which pixel data is high in luminance and in color saturation, into pixel data that is reduced in color saturation. Further, pixel data in the first RGB input signal, which pixel data is low in luminance or in color saturation, is not converted and is used in the second RGB input signal as the way it is.

Figure 8:
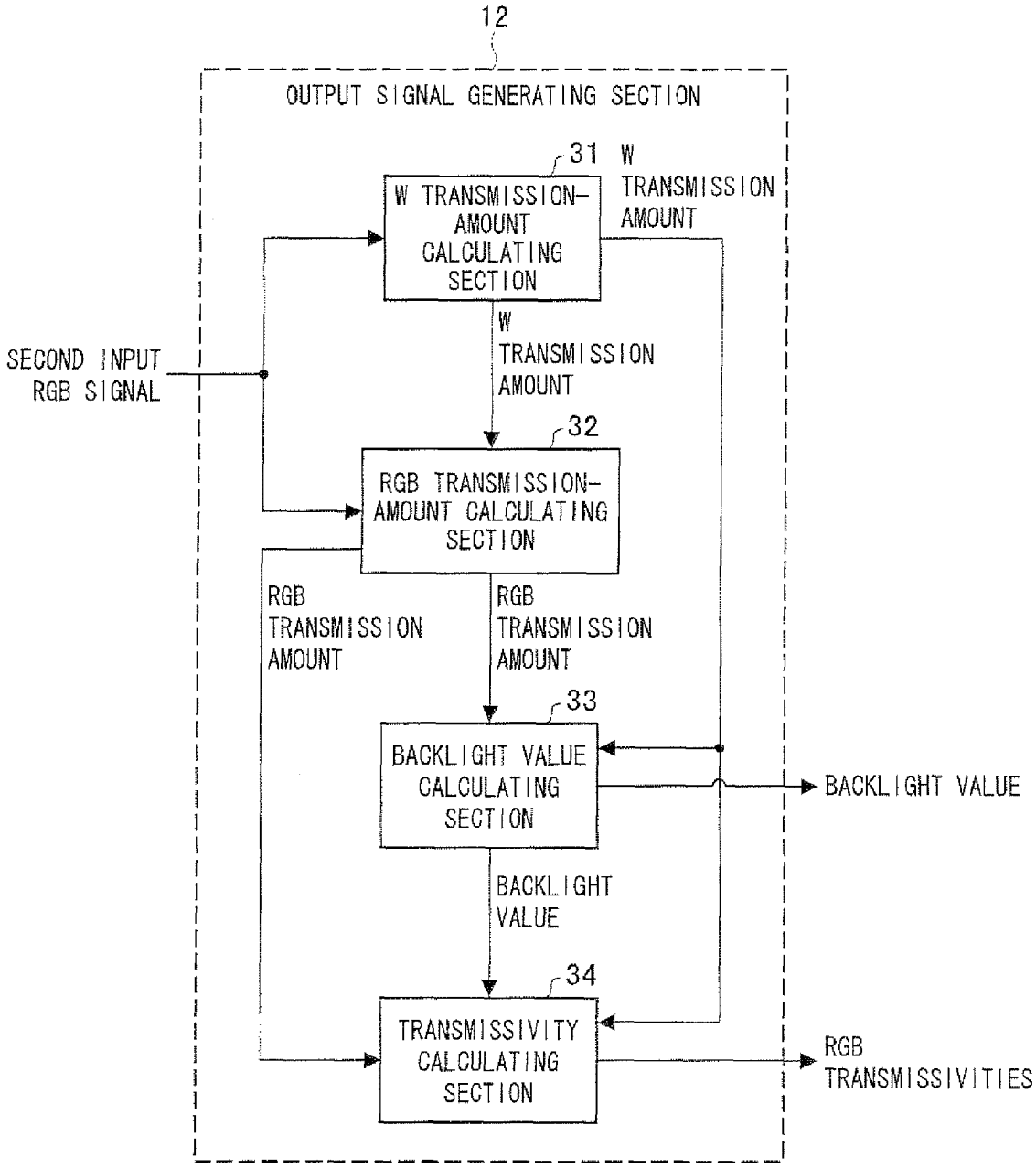
FIG. 8 is a block diagram illustrating an exemplary configuration of an output signal generating section in the liquid crystal display device.
Figure 9:
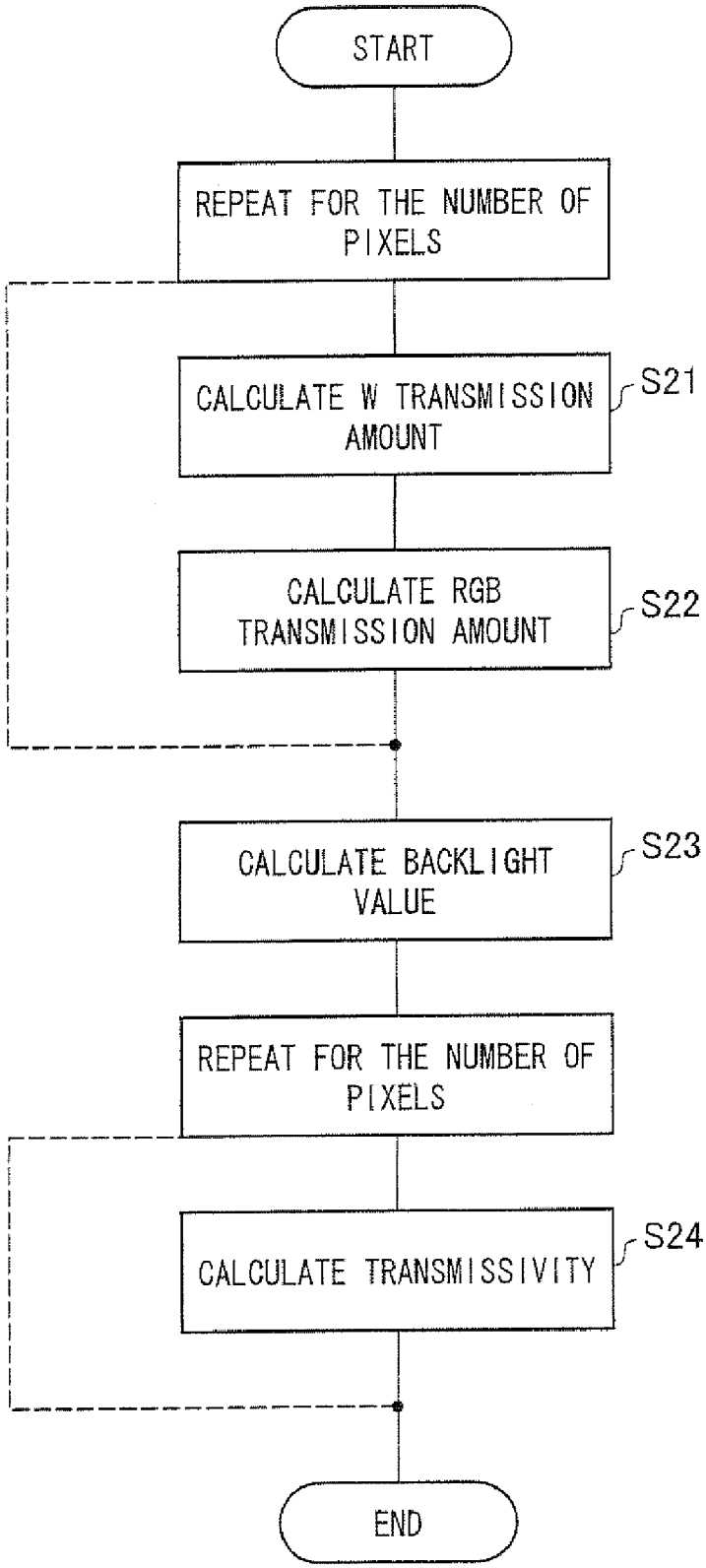
FIG. 9 is a flowchart illustrating a sequence of an operation of the output signal generating section.

The following describes a schematic configuration of the output signal generating section 12, with reference to FIG. 8. As shown in FIG. 8, the output signal generating section 12 includes a W transmission-amount calculating section 31, an RGB transmission-amount calculating section 32, a backlight value calculating section 33 and a transmissivity calculating section 34. Further, FIG. 9 is a flowchart illustrating operation of the output signal generating section 12.

On the basis of the second input RGB signal supplied from the color-saturation reducing section 11, the W transmission-amount calculating section 31 calculates the W transmission amount by Formula (26) below (S21)

$$Wtsi=\min(\max RGBs/(1+1/WR),\ \min RGBs) \quad (26)$$

This W transmission amount is supplied to the RGB transmission-amount calculating section 32, to the backlight value calculating section 33, and to the transmissivity calculating section 34. On the basis of the second input RGB signal and the W transmission amount, the RGB transmission-amount calculating section 32 calculates the KGB transmission amount by Formulae (27) to (29) below (S22):

$$Rtsi=Rsi-Wtsi \quad (27);$$

$$Gtsi=Gsi-Wtsi \quad (28);$$

and $$Btsi=Bsi-Wtsi \quad (29).$$

The RGB transmission amount is supplied to the backlight value calculating section. Steps S21 and S22 are repeated as many times as the number of pixels in the input RGB signal.

The backlight value calculating section 33 calculates the backlight value Wbs in the image by Formula (33) below, on the basis of the RGBW transmission amounts of all pixels in the image, which RGBW transmission amounts have been supplied from the W transmission-amount calculating section 31 and from the KGB transmission-amount calculating section 32 (S23)

$$Wbs=\max(Rts1,\ Gts1,\ Bts1,\ Wts1/WR,\ \ldots\ RtsNp,\ GtsNp,\ BtsNp,\ WtsNp/WR) \quad (33).$$

Calculating the W transmission amount Wts by the foregoing way always gives the result that max (Rts, Gts, Bts) ≧Wts/WR with respect to the respective RGB transmission amounts Rts, Gts, Bts. Therefore, it is also possible in the backlight value calculating section 33 to calculate the backlight value Wbs for the image by Formula (34) below, on the basis of the KGB transmission amounts excluding the W transmission amount, among the RGBW transmission amounts of all pixels in the image, which RGBW transmission amounts are supplied from the W transmission-amount calculating section 31 and the RGB transmission-amount calculating section 32

$$Wbs=\max(Rts1,\ Gts1,\ Bts1,\ \ldots,\ RtsNp,\ GtsNp,\ BtsNp) \quad (34).$$

The backlight value Wbs is supplied to the transmissivity calculating section 34. On the basis of the RGBW transmission amounts supplied from the W transmission-amount calculating section 31 and from the RGB transmission-amount calculating section 32 and the backlight value Wbs supplied from the backlight value calculating section 33, the transmissivity calculating section 34 calculates the respective transmissivities of the subpixels by Formulae (35) to (38) below:

$$rsi=Rtsi/Wbs \quad (35);$$

$$gsi=Gtsi/Wbs \quad (36);$$

$$bsi=Btsi/Wbs \quad (37);$$

and $$wsi=Wtsi/Wbs/WR \quad (38).$$

The process of S24 is repeated as many times as the number of pixels in the RGB input signal.

As the foregoing describes, in the liquid crystal device in accordance with the present embodiment, the process of reducing color saturation is carried out on the RGB input signal, which is the original input, before the backlight value and the RGBW transmissivity are calculated in the output signal generating section 12, whereby it becomes possible to reduce the backlight value reliably.

For example if the liquid crystal panel with the white-color luminance ratio WR=1 is used, the backlight value in the case in which no process of reducing color saturation is to be carried out is 192, considering of the above-mentioned pixel B with (R, G, B)=(160, 256, 64).

In the case in which the process of reducing color saturation is carried out on the pixel B with MAX=256 and Bl Ratio=1/(1+WR)=0.5, the values of the pixel B in the second KGB input signal after the reduction of color saturation are derived as follows:

$$\begin{aligned}\mathrm{MAX}w&=\mathrm{MAX}\times B1\ \mathrm{Ratio} && \text{(from Formula (1))}\\&=256\times0.5\\&=128;\end{aligned}$$

$$\begin{aligned}\alpha&=128/(256-64) && \text{(from Formula (19))}\\&=2/3;\end{aligned}$$

-continued $$Y1 = (2 \times R1 + 5 \times G1 + B1)/8 = (2 \times 160 + 5 \times 256 + 64)/8 = 208;$$

$$Rs1 = \alpha \times R1 + (1 - \alpha) \times Y1 = (2/3) \times 160 + (1 - 2/3) \times 208 = 176; \quad \text{(from Formula (16))}$$

$$Gs1 = \alpha \times G1 + (1 - \alpha) \times Y1 = (2/3) \times 256 + (1 - 2/3) \times 208 = 240; \quad \text{(from Formula 17))}$$

and $$Bs1 = \alpha \times B1 + (1 - \alpha) \times Y1 = (2/3) \times 64 + (1 - 2/3) \times 208 = 112. \quad \text{(from Formula 18))}$$

Thus, the input values RGB in the pixel B after the reduction of color saturation are (176, 240, 112). The backlight value in this case is 128.

In other words, the process of reducing color saturation allows the backlight value to be reduced from 192 to 128 (reduction by approximately 33%).

Further, it is possible to change the level of the process of reducing color saturation, which process is carried out in the present liquid crystal display device, by adjusting the value of Bl Ratio in Formula (1) within the range of 1/(1+WR) to 1. In other words, providing the present liquid crystal display device with the function of changing the value of Bl Ratio allows the user to arbitrarily select which one of the image quality (increase the value of Bl Ratio) or the power saving (lower the value of Bl Ratio) is given a priority. In this case, setting the value of Bl Ratio to 1 results that no process of reducing color saturation is carried out. This means that it is also possible to select whether or not the process of reducing color saturation is to be carried out.

In the present liquid crystal display device, the backlight 16 is basically provided one for plural pixels. Thus, for example the liquid crystal display device shown in FIG. 1 has the configuration in which one white backlight 16 corresponds to the entire screen of the liquid crystal panel 14. The present invention is not limited to this configuration, though. The screen of the liquid crystal panel 14 may be divided into plural areas, and plural backlights may be provided so that it becomes possible to adjust the luminances of the backlights of the respective areas.

Figure 10:
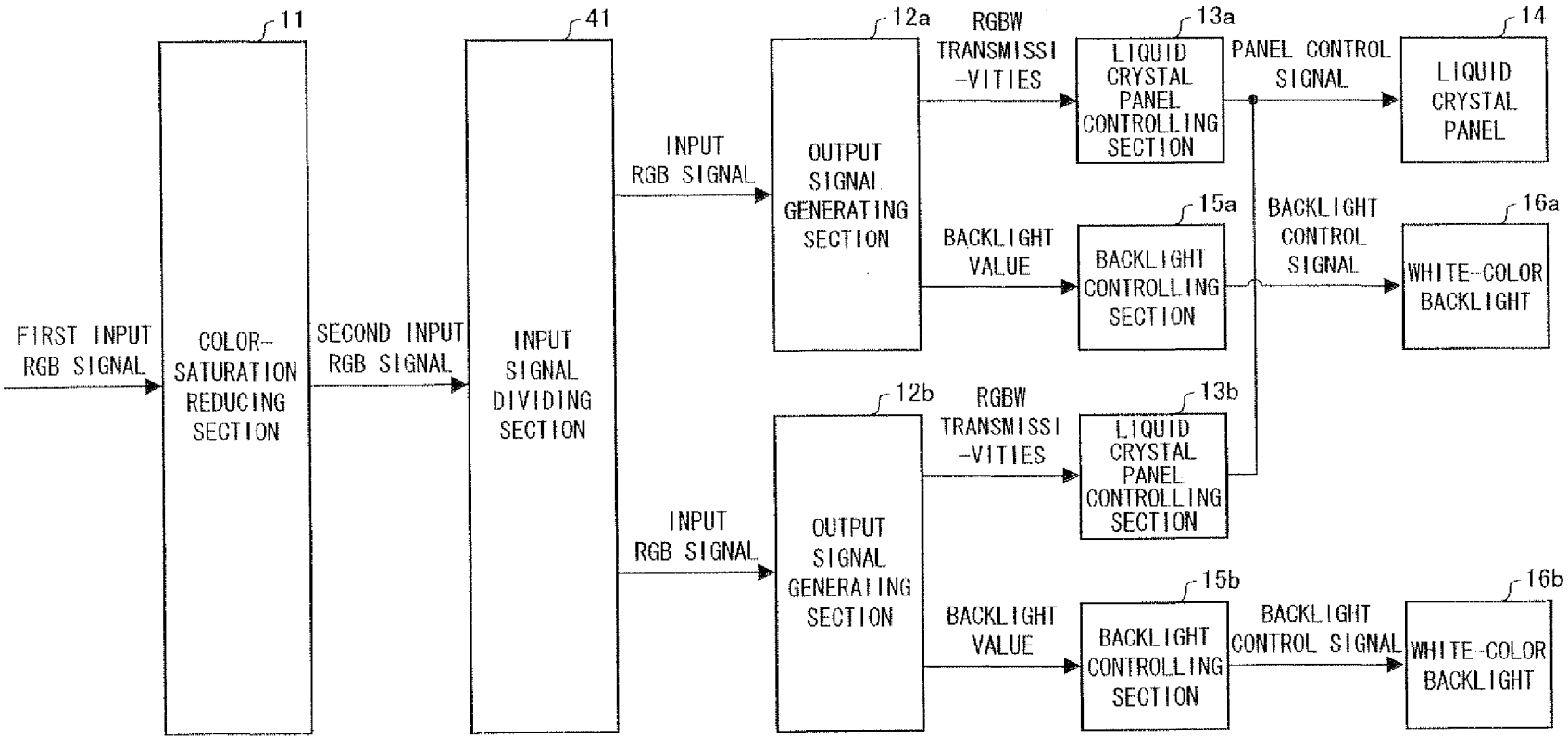
FIG. 10 is a block diagram illustrating a configuration of a main part of the transmissive-type liquid crystal display device in accordance with another embodiment of the present invention.

FIG. 10 shows the case in which one display area has two white backlights. It should be noted that the number of backlights is not limited.

The liquid crystal display device shown in FIG. 10 includes the color-saturation reducing section 11, an input signal dividing section 41, output signal generating sections 12*a* and 12*b*, liquid crystal panel controlling sections 13*a* and 13*b*, the liquid crystal panel 14, backlight controlling sections 15*a* and 15*b*, and white backlights 16*a* and 16*b*.

The input signal dividing section 41 splits one-screen second RGB input signals supplied from the color-saturation reducing section 11 into two-area signals, and supplies the RGB input signals of the respective areas to the output signal generating sections 12*a* and 12*b*. The output signal generating sections 12*a* and 12*b* carry out, on the respective corresponding areas, the same processing as that carried out by the output signal generating section 12 shown in FIG. 1.

Figure 1:
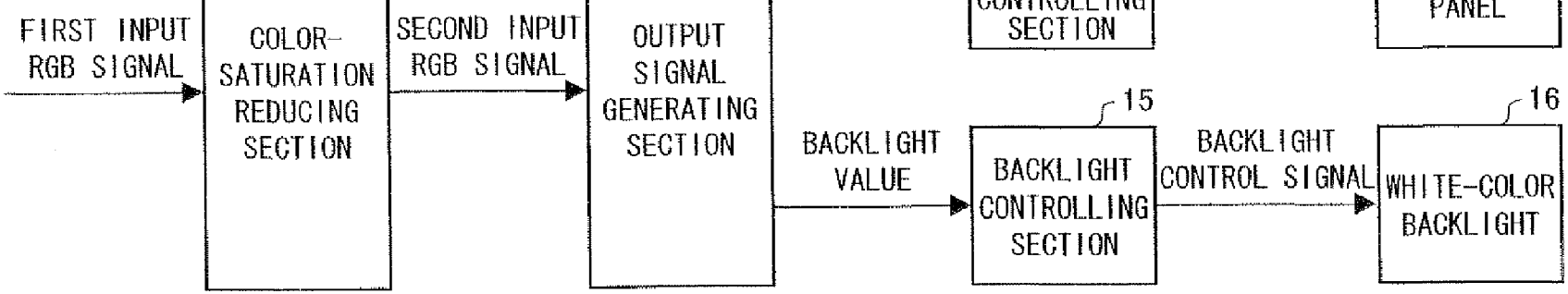
FIG. 1 is a block diagram illustrating a configuration of a main part of a liquid crystal display device in accordance with an embodiment of the present invention.

The liquid crystal panel controlling sections 13*a* and 13*b* carry out, on the respective corresponding areas, the same processing as that carried out by the liquid crystal panel controlling section 13 shown in FIG. 1. Each controlling section controls the transmissivity of a pixel situated at a position corresponding to the counterpart-area of the liquid crystal panel 14.

The backlight controlling sections 15*a* and 15*b* carry out, on the respective corresponding areas, the same processing as that carried out by the backlight controlling section 15 in FIG. 1. Each of the white backlights 16*a* and 16*b* is same as the backlight 16 in configuration. The respective backlights illuminate their corresponding areas.

As the foregoing describes, a single screen is divided into plural areas, and area-by-area controlling is carried out, whereby it becomes possible to reduce the backlight value further. It should be noted that, although the single screen is divided into two areas in the present embodiment, it is also possible to divide a single screen into three or more areas and carry out the area-by-area controlling.

In a general image, similar colors tend to be contiguous in a neighborhood area. Thus, dividing the backlight area as shown in FIG. 10 makes it possible to further darken the backlight for an area where dark pixels gather. Accordingly, the power consumption of the entire backlight is reduced more in the case in which the backlight is divided than in the case in which the backlight is not divided.

The processes that are to be carried out by the color-saturation reducing section 11 or by the output signal generating section 12 are also realizable with software that is operable with personal computers. The following describes how the processes are realized with software.

Figure 11:
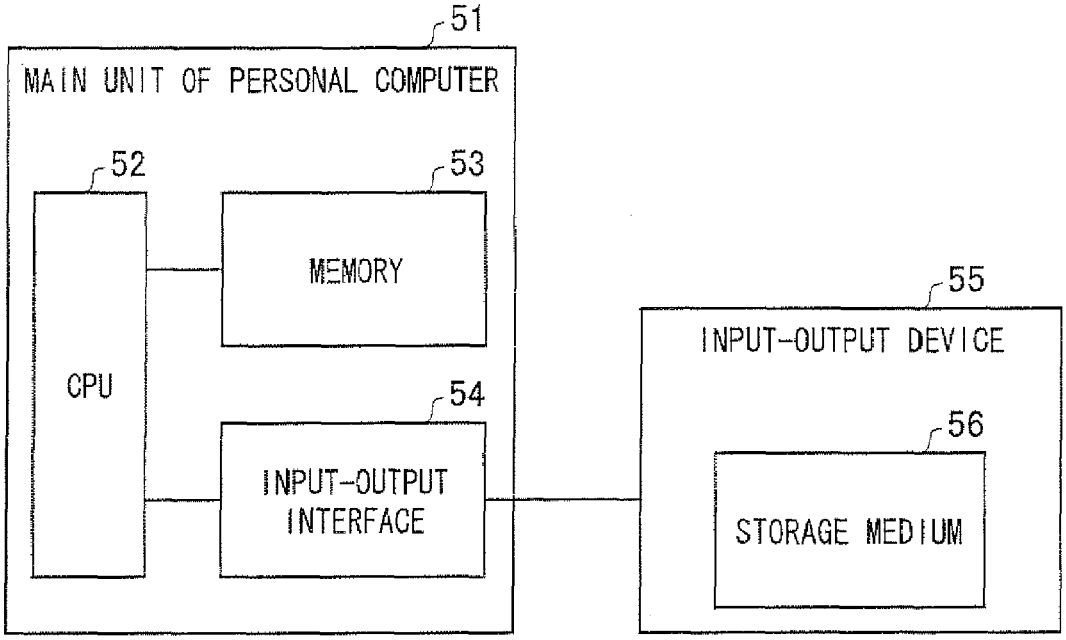
FIG. 11 is a figure illustrating a system configuration in the case in which a display control process of the present invention is realized with software.

FIG. 11 is a figure illustrating a system configuration in the case in which the foregoing processes are realized with software. The system is configured with a main unit 51 of a personal computer and an input-output device 55. The main unit 51 of a personal computer includes a CPU 52, a memory 53, and an input-output interface 54. The input-output device 55 includes a storage medium 56.

The CPU 52 controls the input-output device 55 via the input-output interface 54. The CPU 52 reads out, from the storage medium 56, programs for reducing color saturation and generating output signals, parameter files (e.g. the upper limit of the RGB input signal, the backlight value determination ratio, area information that is used to divide a single screen into plural areas), and input image data to store them into the memory 53.

Further, the CPU 52 reads out, from the memory 53, the programs for reducing color saturation and generating output signals, the parameter files, and the input image data. In accordance with respective commands of the programs for reducing color saturation and generating output signals, the CPU 52 carries out, on the input image data thus supplied, the process of reducing the color saturation and the process of generating output signals, and then controls, via the input-output interface 54, the input-output device 55 to feed, to the storage medium 56, the backlight value after the generation of the output signals and the RGBW transmissivities.

Figure 12:
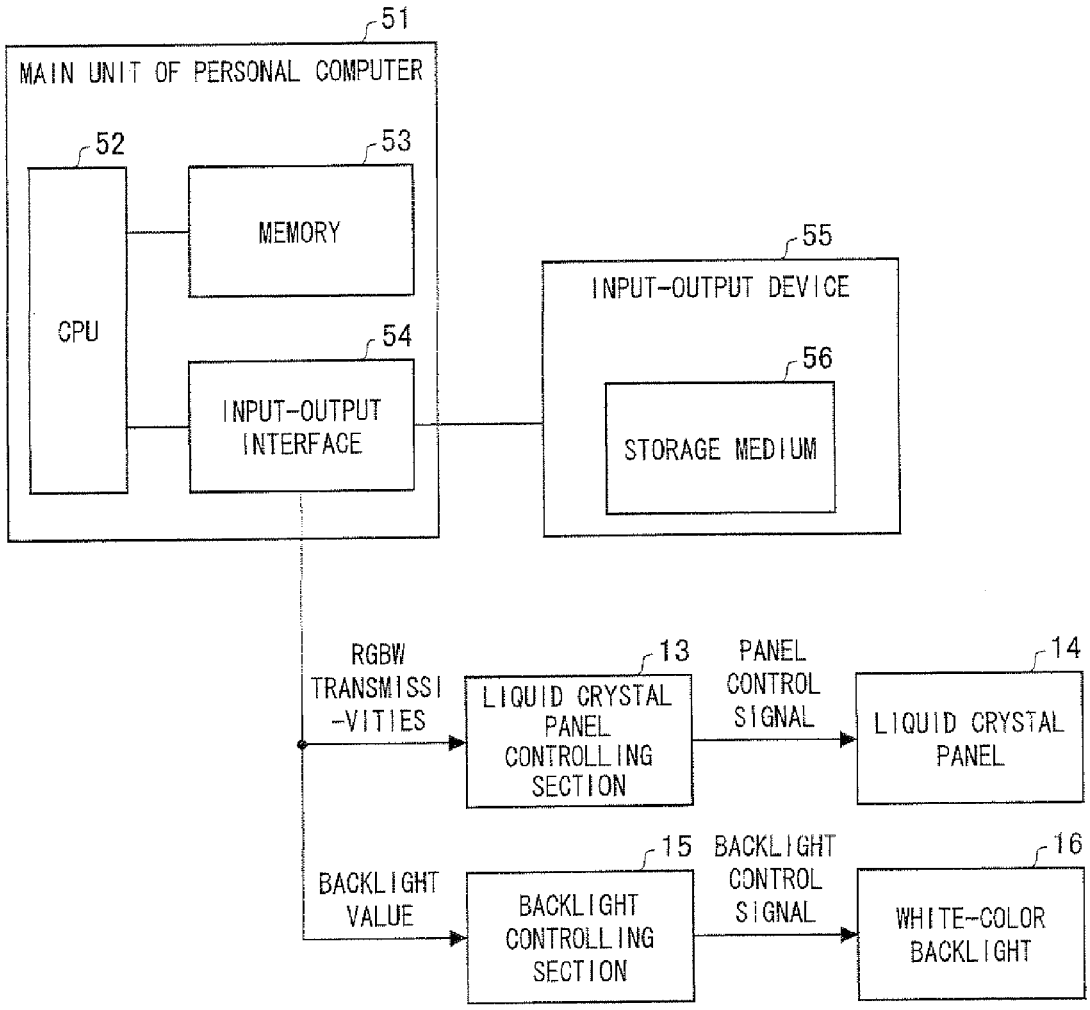
FIG. 12 is a figure illustrating a modified configuration of a system in the case in which a display control process of the present invention is realized with software.
Figure 13:
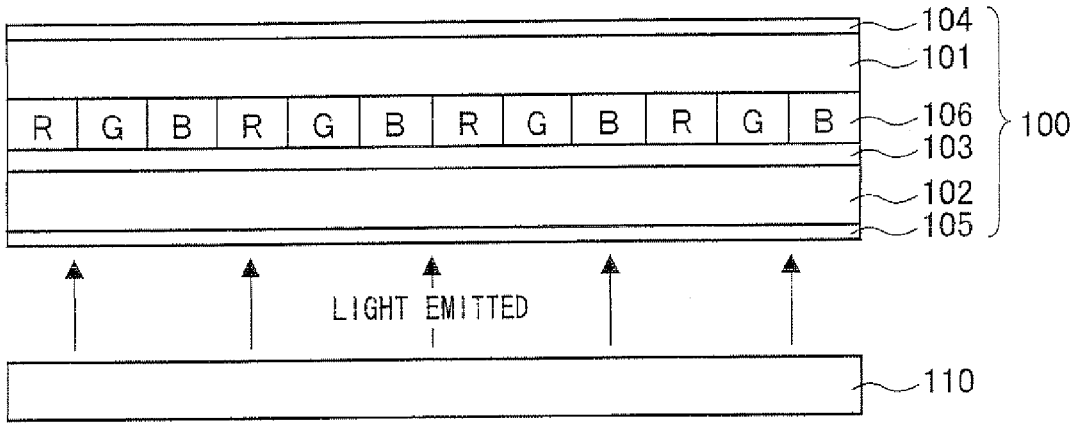
FIG. 13 is a sectional view illustrating a common configuration of the transmissive-type liquid crystal display device.
Figure 14:
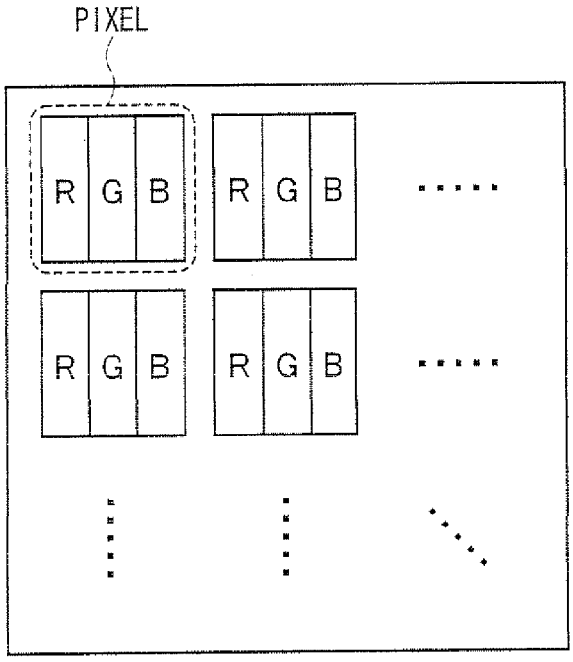
FIG. 14 is a figure illustrating a common arrangement of the subpixels in the transmissive-type liquid crystal display device.

Alternatively, as shown in FIG. 12, the CPU 52 feeds, via the input-output interface 54, the backlight value after the generation of the output signals and the RGBW transmissivities after the generation of the output signals to the backlight controlling section 15 and the liquid crystal panel controlling section 13, respectively, thereby controlling the white backlight 16 and the liquid crystal panel 14 so that an image is actually caused to be displayed.

As the foregoing describes, it is possible with the system to reduce the color saturation and to generate the output signals on the personal computers. This makes it possible to determine, before experimental color-saturation reducing sections and output signal generating sections are actually made, whether the methods of reducing color saturation and generating output signals are appropriate, and to determine the effect of reduction of the backlight value.

As the foregoing describes, a transmissive-type liquid crystal display device in accordance with the present invention includes: a liquid crystal panel having pixels each divided into four subpixels red (R), green (G), blue (B), and white (W); a white-color active backlight by which a luminance of light that is to be emitted is controllable; a color-saturation reducing section that carries out a process of reducing color saturation on pixel data that is high in luminance and in color saturation, among pixel data contained in a first RGB input signal which is an input image, so that the first RGB input signal is converted into a second RGB input signal; an output signal generating section that generates, from the second RGB input signal, a transmissivity signal of each of the subpixels R, G, B, W of each pixel of the liquid crystal panel, and calculates a backlight value in the active backlight; a liquid crystal panel controlling section that controls and drives the liquid crystal panel on the basis of the transmissivity signal generated in the output signal generating section; and a backlight controlling section that controls, on the basis of the backlight value calculated in the output signal generating section, the luminance of light that is to be emitted from the backlight.

With this configuration, the liquid crystal panel in which a single pixel is divided into four subpixels R, G, B, W is employed. This makes it possible to transfer a part of the respective color components R, G, B to the subpixel W, in which no loss (or little loss) of light due to absorption by a filter is produced. This makes it possible to reduce the amount of light absorbed by the color filter and therefore to reduce the backlight value, whereby it becomes possible to achieve reduction in power consumption in the transmissive-type liquid crystal display device.

Further, the process of reducing color saturation is carried out on the first RGB input signal, which is the original input, and the backlight value and the respective RGBW transmissivities are calculated on the basis of the second RGB input signal, which has undergone the process of reducing color saturation. This makes it possible to reduce the backlight value more reliably.

Further, it is preferable in the transmissive-type liquid crystal display device that the color-saturation reducing section reduce only the color saturation of the pixel data on which the process of reducing color saturation is carried out, without changing luminance and hue of the pixel data before and after the process of reducing color saturation With this configuration, only color saturation, which gives less impact on human visual features, is reduced without a change in luminance and hue, both of which give greater impact on the visual features. This makes it possible to restrain the deterioration in image quality as a result of the process of reducing color saturation.

Further, it is preferable in the transmissive-type liquid crystal display device that a level of the process of reducing color saturation be changeable by the color-saturation reducing section.

Further, it is preferable that the range of the level of the process of reducing color saturation be changeable according to the characteristics of the liquid crystal panel that is to be used. One of the characteristics of the liquid crystal panel is the white-color luminance ratio WR, which indicates the ratio of brightness between the white color of the subpixel W with respect to the white color produced by the subpixels RGB in the case in which the subpixels RGBW are same in transmissivity.

This configuration allows the user to selectively determine the balance between the effect of reduction in power consumption and the deterioration in image quality as a result of the process of reducing color saturation.

Further, the transmissive-type liquid crystal display device may be configured in such a manner that the color-saturation reducing section extracts, from the pixel data contained in the first RGB input signal which is the input image, pixel that is high in luminance and in color saturation, in accordance with process (A) below, and carries out, in accordance with process (B) below, a process of reducing the color saturation on the pixel data thus extracted: (A) calculating an upper limit MAXw of the backlight by $$MAXw = MAX \times Bl\ Ratio,$$

and extracting, as the pixel data that is high in luminance and in color saturation, target pixel data that satisfies $$MAXw < \max RGB - \min RGB,$$

where: WR is a white-color luminance ratio (this is a ratio P2/P1 of a display luminance P2 in a case in which a transmissivity of each of the subpixels KGB is 0% and a transmissivity of the subpixel W is x %, with respect to a display luminance P1 in a case in which the transmissivity of each of the subpixels RGB is x % and the transmissivity of the subpixel W is 0%); MAX is the upper limit of the backlight value in a case in which the process of reducing color saturation is not carried out; Bl Ratio is a backlight value determination ratio ($1/(1+WR) \leqq Bl\ Ratio \leqq 1.0$); maxRGB=max (Ri, Gi, Bi); minRGB=min (Ri, Gi, Bi); Ri, Gi, Bi (i=1, 2, . . . , Np) are RGB values of the target pixel in the first RGB input signal; Np is the number of pixels in the input image; max (A, B, . . . ) is a maximum value of A, B, . . . ; and min (A, B, . . . ) is a minimum value of A, B, . . . ); and (B) obtaining, on the basis of the pixel data thus extracted, $$Rsi = \alpha \times Ri + (1-\alpha) \times Yi,$$

$$Gsi = \alpha \times Gi + (1-\alpha) \times Yi, \text{ and}$$

$$Bsi = \alpha \times Bi + (1-\alpha) \times Yi,$$

pixel data after the process of reducing color saturation, where: Rsi, Gsi, Bsi (i=1, 2, . . . , Np) are RGB values of the target pixel in the second RGB input signal after the process of reducing color saturation; Yi (i=1, 2, . . . , Np) is a luminance of the target pixel; and $\alpha = MAXw/(\max RGB - \min RGB)$.

Further, the output signal generating means in the transmissive-type liquid crystal display device may be configured to include: a W transmission-amount calculating section that calculates a transmission amount (Wtsi) of the subpixel W in accordance with process (A) of calculating the W transmission amount (Wtsi) by $$Wtsi = \min(\max RGBs/(1+1/WR), \min RGBs),$$

where maxRGBs=max (Rsi, Gsi, Bsi), and minRGBs=min (Rsi, Gsi, Bsi); an RGB transmission-amount calculating section that calculates a transmission amount (Rtsi, Gtsi, Btsi) of each of the subpixels RGB in accordance with process (B) of calculating the RGB transmission amounts (Rtsi, Gtsi, Btsi) by $$Rtsi=Rsi-Wtsi,$$

$$Gtsi=Gsi-Wtsi, \text{ and}$$

$$Btsi=Bsi-Wtsi;$$

a backlight value calculating section that calculates a backlight value (Wbs) in accordance with process (C) of calculating the backlight value (Wbs) by $$Wbs=\max(Rts1, Gts1, Bts1, Wts1/WR, \ldots RtsNp, GtsNp, BtsNp, WtsNp/WR);$$

and a transmissivity calculating means for calculating a transmissivity (rsi, gsi, bsi, wsi) of each of the subpixels RGBW in accordance with process (D) of calculating the RGBW transmissivities (rsi, gsi, bsi, wsi) by $$rsi=Rtsi/Wbs,$$

$$gsi=Gtsi/Wbs,$$

$$bsi=Btsi/Wbs, \text{ and}$$

$$wsi=Wtsi/Wbs/WR,$$

where rsi=gsi=bsi=wsi=0 when Wbs=0.

Further, the transmissive-type liquid crystal display device may be configured in such a manner that a plurality of active backlights are provided with respect to the liquid crystal panel, and controlling a transmissivity of the liquid crystal panel and controlling the backlight value of the backlight are carried out on individual areas that correspond to the plurality of active backlights, respectively.

With the foregoing configuration, the backlight is divided so that it becomes possible to suitably determine the backlight value for each section of the backlight thus divided, whereby it becomes possible to reduce the overall power consumption of the backlight.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A transmissive-type liquid crystal display device, comprising:

a liquid crystal panel having pixels each divided into four subpixels red (R), green (G), blue (B), and white (W);

a white-color active backlight by which a luminance of light that is to be emitted is controllable;

a color-saturation reducing section that carries out a process of reducing color saturation on pixel data that is high in luminance and in color saturation, among pixel data contained in a first RGB input signal which is an input image, so that the first RGB input signal is converted into a second RGB input signal;

an output signal generating section that generates, from the second RGB input signal, a transmissivity signal of each of the subpixels R, G, B, W of each pixel of the liquid crystal panel, and calculates a backlight value in the active backlight;

a liquid crystal panel controlling section that controls and drives the liquid crystal panel on the basis of the transmissivity signal generated in the output signal generating section; and a backlight controlling section that controls, on the basis of the backlight value calculated in the output signal generating section, the luminance of light that is to be emitted from the backlight;

wherein the color-saturation reducing section extracts, from the pixel data contained in the first RGB input signal which is the input image, pixel that is high in luminance and in color saturation, in accordance with process (A) below, and carries out, in accordance with process (B) below, a process of reducing the color saturation on the pixel data thus extracted:

(A) calculating an upper limit MAXw of the backlight by $$MAXw=MAX\times Bl \text{ Ratio},$$

and extracting, as the pixel data that is high in luminance and in color saturation, target pixel data that satisfies $$MAXw<\max RGB-\min RGB,$$

where:

WR is a white-color luminance ratio (this is a ratio P2/P1 of a display luminance P2 in a case in which a transmissivity of each of the subpixels RGB is 0% and a transmissivity of the subpixel W is x %, with respect to a display luminance P1 in a case in which the transmissivity of each of the subpixels RGB is x % and the transmissivity of the subpixel W is 0%);

MAX is the upper limit of the backlight value in a case in which the process of reducing color saturation is not carried out;

Bl Ratio is a backlight value determination ratio having a range of $1/(1+WR)\leqq Bl\ Ratio\leqq 1.0$;

$$\max RGB=\max(Ri, Gi, Bi);$$

$$\min RGB=\min(Ri, Gi, Bi);$$

Ri, Gi, Bi are RGB values of the target pixel in the first RGB input signal, wherein i is an integer between 1 and Np;

Np is the number of pixels in the input image;

max (A, B, . . . ) is a maximum value of A, B, . . . ;

and min (A, B, . . . ) is a minimum value of A, B, . . . ;

and (B) obtaining, on the basis of the pixel data thus extracted, $$Rsi=\alpha\times Ri+(1-\alpha)\times Yi,$$

$$Gsi=\alpha\times Gi+(1-\alpha)\times Yi, \text{ and}$$

$$Bsi=\alpha\times Bi+(1-\alpha)\times Yi,$$

pixel data after the process of reducing color saturation, where:

Rsi, Gsi, Bsi are RGB values of the target pixel in the second RGB input signal after the process of reducing color saturation;

Yi is a luminance of the target pixel; and $$\alpha=MAXw/(\max RGB-\min RGB).$$

2. The device of claim 1, wherein the color-saturation reducing section reduces only the color saturation of the pixel data on which the process of reducing color saturation is carried out, without changing luminance and hue of the pixel data before and after the process of reducing color saturation.

3. The device of claim 1, wherein a level of the process of reducing color saturation is changeable by the color-saturation reducing section.

4. A transmissive-type liquid crystal display device, comprising:

a liquid crystal panel having pixels each divided into four subpixels red (R), green (G), blue (B), and white (W);

a white-color active backlight by which a luminance of light that is to be emitted is controllable;

a color-saturation reducing section that carries out a process of reducing color saturation on pixel data that is high in luminance and in color saturation, among pixel data contained in a first RGB input signal which is an input image, so that the first RGB input signal is converted into a second RGB input signal;

an output signal generating section that generates, from the second RGB input signal, a transmissivity signal of each of the subpixels R, G, B, W of each pixel of the liquid crystal panel, and calculates a backlight value in the active backlight;

a liquid crystal panel controlling section that controls and drives the liquid crystal panel on the basis of the transmissivity signal generated in the output signal generating section;

a backlight controlling section that controls, on the basis of the backlight value calculated in the output signal generating section, the luminance of light that is to be emitted from the backlight, wherein a level of the process of reducing color saturation is changeable by the color-saturation reducing section, wherein the color-saturation reducing section determines, on the basis of a white-color luminance ratio WR, the range of change of the level of the process of reducing color saturation, where the white-color luminance ratio WR is aratio P2/P1 of a display luminance P2, in a case in which a transmissivity of each of the subpixels RGB is 0 % and a transmissivity of the subpixel W is x %, to a display luminance P1, in a case in which the transmissivity of each of the subpixels RGB is x % and the transmissivity of the subpixel W is 0%.

5. The device of claim 1, wherein the output signal generating means includes:

a W transmission-amount calculating section that calculates a transmission amount Wtsi of the subpixel W in accordance with process (A) of calculating the W transmission amount Wtsi by $$Wtsi=\min(\max RGBs/(1+1/WR), \min RGBs),$$

where maxRGBs=max (Rsi, Gsi, Bsi), and minRGBs=min (Rsi, Gsi, Bsi);

an RGB transmission-amount calculating section that calculates a transmission amount Rtsi, Gtsi, Btsi of each of the subpixels RGB in accordance with process (B) of calculating the RGB transmission amounts Rtsi, Gtsi, Btsi by $$Rtsi=Rsi-Wtsi,$$

$$Gtsi=Gsi-Wtsi, \text{ and}$$

$$Btsi=Bsi-Wtsi;$$

a backlight value calculating section that calculates a backlight value Wbs in accordance with process (C) of calculating the backlight value Wbs by $$Wbs=\max(Rts1, Gts1, Bts1, Wts1/WR, \ldots RtsNp, GtsNp, BtsNp, WtsNp/WR);$$

and a transmissivity calculating means for calculating a transmissivity rsi, gsi, bsi, wsi of each of the subpixels RGBW in accordance with process (D) of calculating the RGBW transmissivities rsi, gsi, bsi, wsi by $$rsi=Rtsi/Wbs,$$

$$gsi=Gtsi/Wbs,$$

$$bsi=Btsi/Wbs, \text{ and}$$

$$wsi=Wtsi/Wbs/WR,$$

where rsi=gsi=bsi=wsi=0 when Wbs=0.

6. The device of claim 1, wherein: a plurality of active backlights are provided with respect to the liquid crystal panel; and controlling a transmissivity of the liquid crystal panel and controlling the backlight value of the backlight are carried out on individual areas that correspond to the plurality of active backlights, respectively.

7. A non-transitory computer-readable recording medium in which a control program, causing a computer to execute respective processes of the sections defined in Claim 1 and of the means defined in claim 1, is stored.

8. A non-transitory computer-readable recording medium in which a control program, causing a computer to execute respective processes of the sections defined in claim 5 and of the means defined in claim 5, is stored.

* * * * *